US011051580B2

(12) United States Patent
Fujita et al.

(10) Patent No.: US 11,051,580 B2
(45) Date of Patent: Jul. 6, 2021

(54) SHOE HAVING CUSHIONING STRUCTURE

(71) Applicant: ASICS CORPORATION, Hyogo (JP)

(72) Inventors: Hisanori Fujita, Hyogo (JP); Yoshinori Fujita, Hyogo (JP); Norihiko Taniguchi, Hyogo (JP); Junichiro Tateishi, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 55 days.

(21) Appl. No.: 16/341,056

(22) PCT Filed: Oct. 14, 2016

(86) PCT No.: PCT/JP2016/080594
§ 371 (c)(1),
(2) Date: Apr. 10, 2019

(87) PCT Pub. No.: WO2018/070045
PCT Pub. Date: Apr. 19, 2018

(65) Prior Publication Data

US 2019/0231026 A1 Aug. 1, 2019

(51) Int. Cl.
*A43B 3/00* (2006.01)
*A43B 13/12* (2006.01)
(Continued)

(52) U.S. Cl.
CPC ..... *A43B 13/12* (2013.01); *A43B 3/0063* (2013.01); *A43B 7/32* (2013.01); *A43B 13/04* (2013.01);
(Continued)

(58) Field of Classification Search
CPC ..... A43B 3/0063; A43B 7/144; A43B 7/148; A43B 13/12; A43B 13/125; A43B 13/187; A43B 13/189
See application file for complete search history.

(56) References Cited

U.S. PATENT DOCUMENTS 4,794,707 A * 1/1989 Franklin ..... A43B 7/14 36/107
5,463,824 A * 11/1995 Barna ..... A43B 7/14 36/173
(Continued)

FOREIGN PATENT DOCUMENTS

EP 2462827 6/2012
JP H2-140102 5/1990
(Continued)

OTHER PUBLICATIONS

International Search Report Issued in PCT/JP2016/080594 dated Dec. 27, 2016.

*Primary Examiner* — Sharon M Prange
(74) *Attorney, Agent, or Firm* — JCIPRNET

(57) ABSTRACT

A shoe includes: a shock-absorbing member formed from a foam body including a thermoplastic resin; a solid-form soft member including a polymer resin, having a greater weight per unit volume and a lower hardness than the shock-absorbing member, and having a smaller volume change per unit volume, than the shock-absorbing member, for a change in external pressure within a predetermined external pressure range; and an outsole including a thermoplastic resin, having a tread surface, and rolled up upward along at least a part of an outer edge thereof, thereby defining an accommodating portion to accommodate the soft member between the outsole and the lid, wherein: the shock-absorbing member forms the lid to lid the soft member from a side of an upper; and the soft member is wrapped in the accommodating portion, being in contact with at least a part of inner surfaces of the shock-absorbing member and the outsole.

17 Claims, 17 Drawing Sheets

(51) Int. Cl.
*A43B 13/18* (2006.01)
*A43B 7/32* (2006.01)
*A43B 13/04* (2006.01)

(52) U.S. Cl.
CPC ..... *A43B 13/125* (2013.01); *A43B 13/18* (2013.01); *A43B 13/187* (2013.01); *A43B 13/189* (2013.01)

(56) References Cited

U.S. PATENT DOCUMENTS 5,926,974 A 7/1999 Friton
6,658,766 B2 * 12/2003 Kraeuter ..... A43B 5/00 36/102
7,020,988 B1 * 4/2006 Holden ..... A43B 7/1425 36/141
7,249,425 B2 * 7/2007 Wang ..... A43B 7/144 36/29
8,209,885 B2 * 7/2012 Campbell ..... A43B 1/14 36/28
2002/0092201 A1 7/2002 Kraeuter et al.
2005/0086838 A1 * 4/2005 Khantzis ..... A43B 7/1425 36/30 R
2007/0193065 A1 8/2007 Nishiwaki et al.
2010/0192420 A1 8/2010 Favraud
2014/0007456 A1 * 1/2014 Tadin ..... A43B 7/1465 36/43
2016/0015122 A1 1/2016 Nishiwaki et al.
2016/0338446 A1 * 11/2016 Merlo ..... A43B 13/20
2017/0231323 A1 * 8/2017 Baltierra ..... A43B 7/1425 36/28

FOREIGN PATENT DOCUMENTS

JP H8-38211 2/1996
JP H9-65904 3/1997
JP 2011-177206 9/2011
WO 2006-038338 4/2006

* cited by examiner

SHOE HAVING CUSHIONING STRUCTURE

CROSS-REFERENCE TO RELATED APPLICATION

This application is a 371 application of the international PCT application serial no. PCT/JP2016/080594, filed on Oct. 14, 2016. The entirety of the abovementioned patent application is hereby incorporated by reference herein and made a part of this specification.

TECHNICAL FIELD

The present invention relates to a shoe that features a characteristic cushioning structure on the shoe sole.

BACKGROUND ART

In recent years, various shoes have been developed with the aim of increasing the cushioning property of the shoe sole.

CITATION LIST

Patent Literature

[First Patent Document] U.S. Pat. No. 5,926,974B (Friton: FIG. 2)

[Second Patent Document] US2016/0015122A1 (Nishiwaki, et al., FIG. 12E)

[Third Patent Document] US2002/0092201A1 (Kraeuter, et al., FIG. 11, 12)

[Fourth Patent Document] US2010/0192420A1 (Favraud, FIG. 4)

[Fifth Patent Document] EP2,462,827A2 (FIG. 2)

SUMMARY OF INVENTION

FIG. 15A to FIG. 15C show the structure of a shoe sole disclosed in Friton, supra. This prior art example seems to disclose the following as the description corresponding to FIG. 2 of the prior document.

"[P]ods 130 comprise a core of relatively soft resilient foam material 150 covered with a relatively thin layer of wear resistance material 170."

"Foam material 150 may be the same material that is used for midsole 9, e.g., a foamed EVA. (ellipsis) Instead of, or in addition to, soft foam material 150, other soft cushioning elements can be used. For example, gas or gel filled bladders can be used."

FIG. 15B and FIG. 15C show structures shown in FIG. 31 and FIG. 32, respectively, of this prior document.

As shown in FIG. 15B and FIG. 15C, when the surface of the pod steps on the rock surface 610, the foam material 150 is compressed, and the wear resistance material 170 deforms in conformity with the surface 610.

However, this prior art example seems to fail to disclose the outsole assisting the restoration of the soft member after the soft member is deformed by receiving an external force through the outsole.

This prior art example also fails to disclose using a solid-form soft member whose Asker C hardness is 20° to 45° as the soft member wrapped by the outsole.

This prior art example also fails to disclose using a solid-form and jelly-form viscoelastic material as the soft member wrapped by the outsole.

Moreover, this prior art example fails to disclose the low-hardness jelly-form soft member being wrapped while being in contact with the inner surface of the outsole.

It also fails to disclose using a thermoplastic resin as the outsole.

FIG. 15D shows a midsole 100 having a layered structure disclosed in FIG. 12F of Nishiwaki, et al., supra. In paragraphs 0141 and 0146, this prior art example discloses the following.

In FIG. 15D, "low-resilience materials OOS were virtually provided in steps of 5° from 35° to 60°, while normal foams OON were virtually provided from 50° to 65°."

"[T]he normal foam OON of the upper layer 200 is layered on the low-resilience material OOS of the lower layer 300."

Claim 1 and paragraph 0033 of the prior art example disclose the following.

"[A] mid sole 100 is arranged on an outsole having a tread surface."

"The outsole is typically formed by a foamed rubber material or a non-foamed rubber or urethane material."

However, this prior art example fails to disclose the soft member being wrapped while being in contact with the inner surface of the outsole.

FIG. 15E and FIG. 15F show shoe structures disclosed in Kraeuter, et al., supra. This prior art example seems to disclose the following.

"Sole element 180 (of the heel), which is filled with a shock-absorbing midsole material 960 such as EVA, is affixed to the bottom surface of the upper structure"

"[S]ole element 180 includes an outer abrasion-resistance layer made of a material such as a durable rubber. The outer layer encases a cushioning material such as EVA or PU"

"[T]he heel sole element includes a plurality of deformable, sealed, hollow members"

"[T]he deformable, sealed, hollow members contain a fluid selected from the group consisting of a gas, a gel and a liquid"

However, this prior art example fails to disclose using a solid-form soft member having an Asker C hardness of 20° to 45° as the soft member wrapped by the outsole.

This prior art example fails to disclose using a solid-form and jelly-form viscoelastic material as the soft member wrapped by the outsole.

It also fails to disclose using a thermoplastic resin as the (out) sole element 180.

FIG. 16A shows a shoe sole disclosed in FIG. 4 of Favraud, supra. In paragraphs 0043 and 0044, this prior art example seems to disclose the following.

"In general, at least a part of the cavities 400 is respectively filled with a packing 1000, and the packing 1000 is an elastically deformable material, for example."

"Preferably, the packing comes in the form of an element made of an elastically deformable material, for example in the form of a flexible pocket of air or foam with a variable density based on the desired absorption characteristics or gel or balls or the like."

FIG. 16B shows the structure of a shoe sole disclosed in FIG. 2 of EP2,462,827A2, supra. Paragraph 0022 of this prior art example seems to disclose the following.

EVA having an Asker C hardness of about 55° is mentioned as an example of the material of the pads 171 and 191. A synthetic rubber having a Shore A hardness of 65° is mentioned as an example of the outsole.

It is a primary object of the present invention to provide a shoe having a shoe sole structure, with which it is capable of exerting a high cushioning property, and the soft member, which has been deformed by receiving an external force, can easily restore.

The present invention provides a shoe including:

a solid-form soft member S including a polymer resin component and having a weight per unit volume (hereinafter referred to as a "specific gravity") of 0.31 to 1.2 and an Asker C hardness of 20° to 45°;

a lid 1 configured to lid the soft member S from a side of an upper; and an outsole 4 including a thermoplastic resin component and having a tread surface 4S, the outsole 4 being rolled up upward along at least a part of an outer edge thereof, thereby defining, with the lid 1, an accommodating portion 4A configured to accommodate the soft member S therein, wherein the soft member S is wrapped in an accommodating portion 4A while being in contact with inner surfaces Nf and 4*f* of a lid 1 and the outsole 4.

The Asker C hardness being 20° to 45° means that the value as measured by an Asker C hardness tester is 20° to 45°.

The soft member having the C hardness of 20° to 45° (hereinafter referred to as low-hardness) is softer as compared with an ordinary midsole foam body. Therefore, when a dynamic load or an impact load is applied to the soft member upon landing, the soft member easily absorbs an energy. When the soft member is a low-resilience material, it has a large absorbing capacity and a high cushioning property. When the soft member is a high-resilience material, the absorbed energy becomes a reaction force to enhance the running ability, etc.

When the low-hardness soft member is arranged so as to be in contact with the inner surface of the outsole and is not wrapped by the outsole, etc., the soft member will significantly expand in the horizontal direction, and the deformation due to a compressive load will be excessive. This may lower the stability performance of the shoe sole.

Herein, the soft member of the present invention is wrapped while being in contact with the inner surfaces of the lid and the outsole. With the soft member wrapped by the outsole, etc., the deformation is suppressed by the outsole. Therefore, even with a low hardness, it will be possible to maintain the stability performance of the shoe sole.

Even when the low-hardness soft member is wrapped by the outsole, etc., if the volume of the soft member becomes too small in the outsole due to an external force, it will be difficult to realize the effect of suppressing the deformation by means of the outsole. Therefore, the low-hardness soft member should have physical properties such that it undergoes a small change (decrease) in volume when compressively deformed.

Such physical properties will be ensured by the specific gravity of the soft member S being large. The reason for this will now be described.

In the present invention, the soft member having a specific gravity of 0.31 to 1.2 has a larger specific gravity than a foam body that is used as an ordinary midsole. A soft member having such a large specific gravity can be obtained from a non-foam body of a resin or a foam body of a resin having a small expansion ratio.

It will be readily understood that when the soft member is a non-foam body of a resin, as opposed to an ordinary midsole foam body, the volume change is small when compressively deformed during a run, for example.

When the soft member is a foam body of a resin, the soft member having a specific gravity of 0.31 to 1.2 has a small expansion ratio and the distance between bubbles is larger than an ordinary midsole foam body. Therefore, it is unlikely to buckle when compressively deformed. Moreover, the number of bubbles per unit volume to be compressed is small. Therefore, the volume change when compressively deformed will be small.

That is, the soft member having a large specific gravity has a relatively small volume change when compressively deformed. Thus, by being wrapped by the outsole, etc., excessive deformation will be suppressed.

When the soft member is not in a solid form but is a fluid such as a liquid, the soft member will have free flowability. Therefore, even if the soft member is wrapped by the outsole, etc., the above-described deformation suppressing effect will not be realized.

For similar reasons, when the Asker C hardness of the soft member is less than 20°, the deformation of the soft member will be excessive and the soft member is likely to be damaged in the outsole.

Sealing a liquid in a bladder or a pod, for example, and arranging it in the accommodating portion will lead to an increase in the number of parts.

In contrast, in the present invention, the solid-form soft member is in contact with the inner surfaces of the lid and the outsole. Therefore, it is possible to realize the above-described deformation suppressing effect without increasing the number of parts.

In the present invention, the outsole is rolled up upward along at least a part of the outer edge of the shoe sole. With such a structure, the soft member can be arranged along the outer edge of the shoe sole, thereby increasing the degree of freedom in the layout of the soft member.

Where the outsole includes a thermoplastic resin component, or where the outsole preferably includes a thermoplastic resin component as its primary component, it is possible to smoothly mold the inner surface of the outsole as compared with a case where it is made of a rubber. In this case, the soft member is in contact with the smooth inner surface of the outsole, and the soft member is likely to come into close contact with the smooth inner surface as if by suction due to the atmospheric pressure acting upon the soft member. Therefore, the dynamic structure of the soft member is a cantilever, and excessive deformation of the soft member may be suppressed.

Herein, "as its primary component" means that the thermoplastic resin component is included by a larger amount (greater weight) than other resin components (e.g., a rubber). In order to realize the effect of smoothing the inner surface, the weight proportion of the thermoplastic resin component, which is the primary component, is preferably 50 to 100 wt %, more preferably 80 to 100 wt %, even more preferably 90 to 100 wt %, and most preferably 100 wt %, of the entire resin component of the outsole.

In the present invention, the soft member including a polymer resin component means to include cases where the soft member is not a thermoplastic resin. For example, the soft member may include a cured flexible polyurethane as its primary component. With such a cured flexible polyurethane, it is possible to realize physical properties such that the C hardness is about 40° to 45° even with a non-foam body that does not include a plasticizer, and it is possible to realize physical properties with an even lower hardness by using a foam body instead.

When the soft member is made of a thermoplastic resin, the material includes a thermoplastic resin component and any other component as needed. Examples of the thermoplastic resin component include a thermoplastic elastomer and a thermoplastic resin, for example.

As to the type of the thermoplastic elastomer, for example, a styrene-based elastomer such as styrene ethylene butylene styrene block copolymer (SEBS), an ethylene-vinyl acetate copolymer elastomer, and the like, may be used.

As to the type of the thermoplastic resin, for example, a vinyl acetate-based resin such as ethylene-vinyl acetate copolymer (EVA), polystyrene, a styrene butadiene resin, and the like, may be used as the thermoplastic resin.

These resin components may each be used alone or two or more of them may be used in combination.

BRIEF DESCRIPTION OF DRAWINGS

In FIG. 1A to FIG. 2B and FIG. 4A to FIG. 5B, adhesion areas (attachment areas) are dotted.

In FIG. 17A to FIG. 17C, four of a large number of ribs are dotted.

DESCRIPTION OF EMBODIMENTS

Figures 1A, 1B:
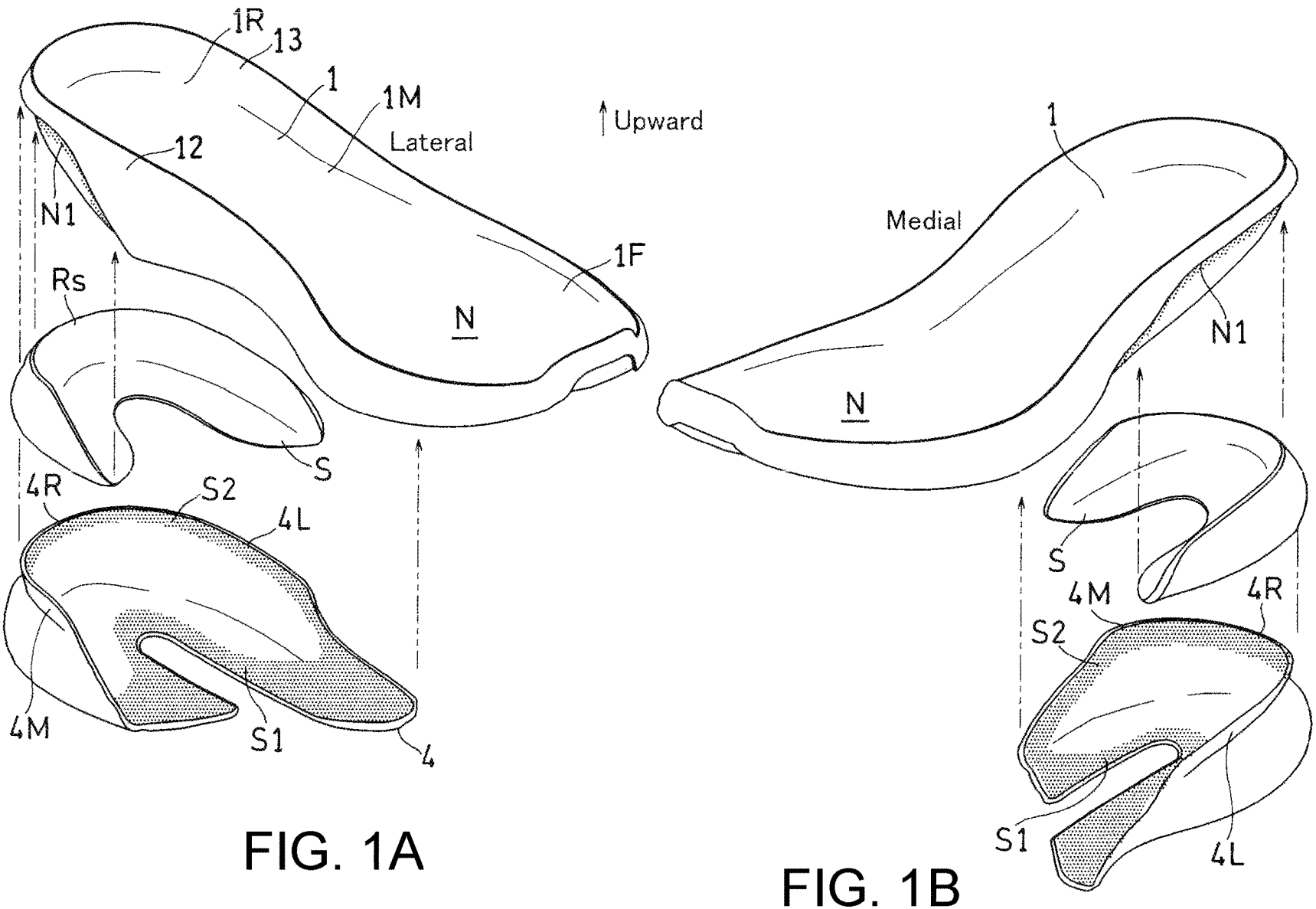
FIG. 1A and FIG. 1B are schematic exploded perspective views showing a shoe sole of Embodiment 1 of the present invention as seen from an upper-medial diagonal direction and an upper-lateral diagonal direction, respectively.

Preferably, the solid-form soft member is a jelly-form viscoelastic material (body).

The solid form means an elastic body capable of maintaining a certain shape, and includes a solid whose molecular arrangement does not have significant regularity (amorphous).

When the jelly-form viscoelastic material includes a thermoplastic resin component, microscopically, fiber-shaped or bar-shaped thermoplastic resin polymers three-dimensionally mesh together (forming a three-dimensional mesh structure). Moreover, it may be a viscoelastic material in which a plasticizer as a dispersion medium is held in a three-dimensional mesh structure. Note that the jelly-form viscoelastic material does not need to include a plasticizer.

A plasticizer refers to what gives flexibility to a plastic material such as a thermoplastic resin, and may include a so-called softener.

With a soft member including such a plasticizer by a large amount, it is possible to easily obtain a member that is soft and has an Asker C hardness of about 20° to 45°, even if it is a non-foam body or low-foamed. When the soft member includes the plasticizer by a large amount, it is possible to obtain a soft member that is a jelly-form flexible solid, just like seaweed fibers become a jelly-form solid containing a large amount of water therein, for example.

Therefore, the plasticizer as a dispersion medium means that the plasticizer is included in a three-dimensional mesh structure by a large amount. For example, it means that the plasticizer is included by 60% to 300 wt % with respect to the primary component of the thermoplastic resin. The plasticizer is included more preferably by 70% to 200%, and most preferably by 80% to 200%. Note however that the present invention does not limit the amount of the plasticizer.

The plasticizer may be a paraffin oil, for example, or any of various other plasticizers.

As described above, in order to reduce the volume change of the soft member, it is preferably non-foamed or it preferably has a small expansion ratio, in which case the specific gravity of the soft member increases. In view of this, the specific gravity of the soft member is preferably 0.4 or more, more preferably 0.5 or more, particularly preferably 0.6 or more, and most preferably 0.65 or more.

As to a non-foamed soft member, when SEBS (styrene ethylene-butylene styrene triblock copolymer), which is a styrene-based thermoplastic elastomer, was used as the thermoplastic resin and a paraffin oil as the plasticizer, there was obtained a soft member having a specific gravity of about 0.9 and a C hardness of about 40°. The weight ratio between the resin and the plasticizer was 100:150. As to cases where the soft member is a foam body, when a compound including SEBS (styrene ethylene-butylene styrene triblock copolymer), which is a styrene-based thermoplastic elastomer, as the thermoplastic resin and a paraffin oil as the plasticizer was foam-molded, there was obtained a soft member having a specific gravity of about 0.7 and a C hardness of about 25°. Then, the weight ratio between the resin and the plasticizer was 100:100.

It will be preferred to use a thermoplastic resin with a large amount of a plasticizer added thereto so that the expansion ratio is not too large (including non-foamed), i.e., the specific gravity is not too small and so that a low-hardness soft member can be obtained.

On the other hand, when the specific gravity of the soft member is too large, the weight of the shoe sole will be too heavy. In view of this, the specific gravity of the soft member S is preferably 1.1 or less, more preferably 1.05 or less, and most preferably 1.0 or less.

In view of the above, a preferred example of a jelly-form soft member has a specific gravity of 0.65 to 1.0 and includes a thermoplastic resin component.

Preferably, the outsole and the soft member include a skirt portion and/or an outwardly-protruding curved portion along at least a part of an outer edge of a shoe sole.

Figure 9A:
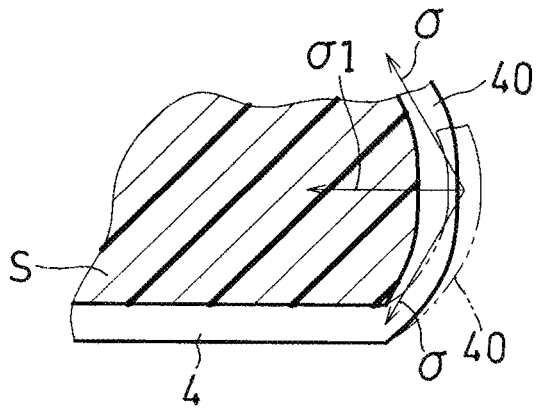
FIG. 9A, FIG. 9B and FIG. 9C are cross-sectional views each showing an area of the corner of the shoe sole.
Figure 9B:
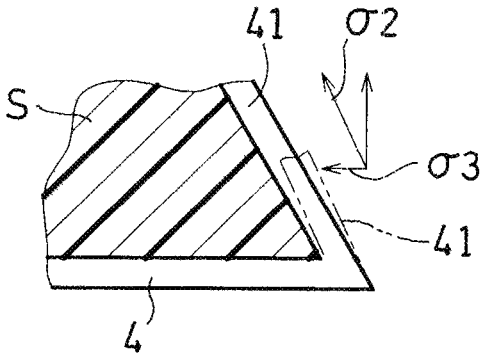
Figure 9C:
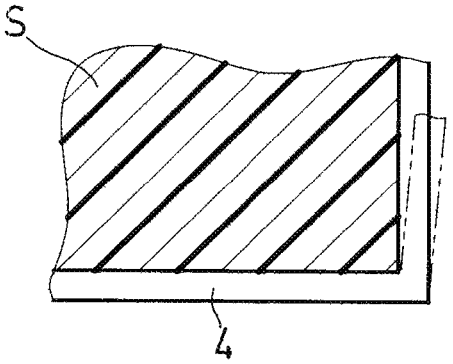

The functions and effects of such a structure will be described with reference to FIG. 9A to FIG. 9C. FIG. 9A to FIG. 9C each show a corner portion of a shoe sole.

The outsole 4 of FIG. 9A includes a curved portion 40. The outsole 4 of FIG. 9B includes a skirt portion 41. The outsole 4 of FIG. 9C does not include the curved portion 40 or the skirt portion 41.

Now, if a compressive load acts in the up-down direction upon the soft members S of FIG. 9A to FIG. 9C, the soft member S having a small volume change expands in the horizontal direction. Then, the outsole 4 wrapping the soft member S also deforms and expands as indicated by a solid line to a two-dot-chain line.

When the outsole 4 has the curved portion 40 as shown in FIG. 9A, a stress (hoop stress) σ along the curve occurs on the curved portion 40 upon deformation. The resultant force σ1 of the hoop stress is the force by which the outsole 4 pushes back the soft member. Therefore, the soft member S will exert a strong cushioning property while keeping stability performance upon deformation. The resultant force σ1 will facilitate the restoration of the deformed soft member.

When the outsole 4 has the skirt portion 41 as shown in FIG. 9B, a diagonally upward stress σ2 occurs on the skirt portion 41 upon deformation. The stress σ2 includes a component force σ3 in the horizontal direction. The component force σ3 is the force by which the outsole 4 pushes back the soft member S. Therefore, effects similar to those of the curved portion 40 described above will be realized.

As opposed to these, in the case of FIG. 9C, a stress to be the reaction force does not occur in the outsole 4 during the initial period of deformation, i.e., at the instance when the soft member S starts expanding horizontally. Moreover, the stress to be the reaction force after the soft member S has expanded horizontally will be smaller as compared with the cases of FIG. 9A and FIG. 9B.

In another aspect, a shoe of the present invention includes:

a shock-absorbing member N formed from a foam body including a thermoplastic resin component;

a solid-form soft member S including a polymer resin component, having a greater weight per unit volume than the shock-absorbing member N, having a lower hardness than the shock-absorbing member N, and having a smaller volume change per unit volume, than the shock-absorbing member N, for a change in external pressure within a predetermined range of external pressure;

a lid 1 configured to lid the soft member S from a side of an upper; and an outsole 4 including a thermoplastic resin component and having a tread surface 4S, the outsole 4 being rolled up upward along at least a part of an outer edge thereof, thereby defining an accommodating portion 4A configured to accommodate the soft member S between the outsole 4 and the lid 1, wherein the soft member S is wrapped in the accommodating portion 4A while being in contact with at least a part of inner surfaces Nf and 4*f* of the lid 1 and the outsole 4.

Figure 11:
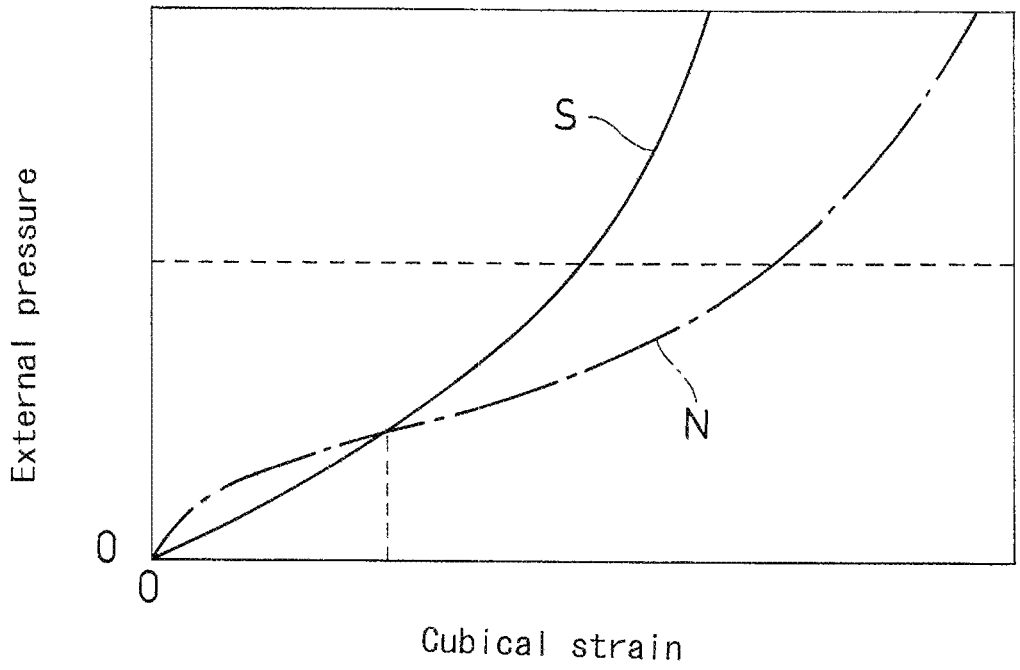
FIG. 11 is a conceptual graph showing how the volume changes against the external pressure of the soft member and the shock-absorbing member.

The soft member has a lower hardness than the shock-absorbing member. Therefore, under circumstances where the external pressure is close to the atmospheric pressure (zero), there may be a region where the volume change due to the change in external pressure is smaller for the shock-absorbing member N than for the soft member S, as shown in FIG. 11. However, the present invention assumes the shoe sole undergoes a dynamic load while the wearer runs or walks. Therefore, the predetermined range of external pressure means an increase in external pressure by about 1 $kgf/cm^2$ to 10 $kgf/cm^2$ from the atmospheric pressure, and means that the requirement is met if the volume change per unit volume for a change P in external pressure ΔV/P (hereinafter referred to as the volume change rate ΔV/P) over at least a part of the range.

Preferably, the volume change rate ΔV/P is smaller for the soft member S for every 1 $kgf/cm^2$ or 2 $kgf/cm^2$ segment of the increase in external pressure by 2 $kgf/cm^2$ to 8 $kgf/cm^2$.

The method for measuring the "volume strain ΔV/P" may be as follows as an example.

First, for a sample such as the soft member or the shock-absorbing member, the volume $V_1$ under no load is measured using a three-dimensional image or a liquid such as water. Then, the sample is put in a pressure chamber, and a liquid is supplied into the pressure chamber to give an external pressure to the sample. The amount of volume change $V_2$ is calculated based on the amount of the liquid supplied and the external pressure, and is divided by the original volume $V_1$, thereby calculating the volume change ΔV per unit volume. The volume change ΔV is divided by the given external pressure P to determine the volume change rate ΔV/P.

Note that it is often the case that one can know a difference in the volume change rate ΔV/P by pressing the soft member S and the shock-absorbing member N hard with the thumb and observe how they are depressed.

A soft member having a small volume change rate ΔV/P not only easily deforms in the accommodating portion of the outsole, but also exerts a repulsive force that outwardly pushes the inner surface of the outsole when deformed. Moreover, after being deformed, it will immediately recover to its original shape by receiving a restoring force of the outsole.

That is, even when the soft member is soft, if the volume change rate ΔV/P is high, the repulsive force is unlikely to be exerted if the soft member has a high expansion ratio, for example.

In the other aspect, preferably, the outsole and the soft member have a skirt portion and/or an outwardly-protruding curved portion along a part of an outer edge of a shoe sole.

Preferably, a fracture strain δ of the soft member S is greater than a fracture strain δ of the shock-absorbing member N. The soft member having physical properties of the other aspect will have a greater fracture strain δ relative to the shock-absorbing member.

The fracture strain δ may be calculated by applying a tensile load on a member to rupture the member and determining the rate of stretch per unit length of the member upon rapture.

Preferably, the outsole has planar and band-shaped attachment areas to be attached to a surface of the shock-absorbing member, and the attachment areas are provided over a portion of the inner surface of the outsole that is not in contact with the soft member.

The soft member typically has a low adhesiveness to other materials. The adhesiveness is low particularly when a large amount of plasticizer is included. Thus, the reliability will be low even if the soft member is bonded to the shock-absorbing member or the outsole. In contrast, the reliability of attachment is improved by attaching the outsole to the shock-absorbing member via the planar and band-shaped attachment areas.

Preferably, at least a portion of the soft member lies under at least a portion of shock-absorbing member.

As described above, the soft member has a greater specific gravity than the shock-absorbing member. Thus, when one attempts to realize a sufficient cushion only with the soft member, the entire shoe sole may become heavy in some cases. In contrast, with the soft member and the shock-absorbing member lying on each other, it will be possible to increase the cushioning function, etc., while maintaining the lightweightness of the shoe sole.

Preferably, the attachment areas comprise first and second attachment areas;

the first attachment area is attached to a bottom surface of the shock-absorbing member; and the second attachment area is attached to a side surface of the shock-absorbing member.

The soft member has a low hardness, and may possibly be significantly deformed by the impact of landing if it is not restrained at all. Even when the soft member is wrapped by the outsole, if the soft member is continuous over a large part, the soft member may exhibit excessive deformation.

In contrast, in the case of this example, the first and second attachment areas are provided on the outsole. Therefore, it is possible to reduce the continuous volume of the soft member, and thus to suppress excessive deformation of the soft member. Since not only the first attachment area but also the second attachment area is provided, the soft member can be arranged on the outer edge of the shoe sole.

Preferably, the first and second attachment areas of the outsole are continuous with each other in a loop, and are arranged to be continuous with each other in a loop along an edge of an entire circumference of the soft member.

The attachment areas continuous with each other in a loop confine the soft member in the accommodating portion of the outsole.

Preferably, the soft member enters a first portion of an undercut that is formed by a skirt portion and/or an outwardly-protruding curved portion of the outsole to fill the first portion, and the outsole and the soft member together define a second portion, into which the shock-absorbing member is fitted.

In this case, the soft member does not only lie on the shock-absorbing member in the up-down direction but is also arranged in the first portion of the undercut so as to be arranged on the side surface or the back surface of the shock-absorbing member. The soft member arranged in such areas will receive impact upon landing before the shock-absorbing member does. Therefore, the effect of the soft member wrapped by the outsole is likely to be exerted.

Preferably, the soft member, the outsole and the shock-absorbing member each have a roll-up portion along at least a portion of an outer edge of a shoe sole;

the roll-up portion of the soft member extends along the roll-up portions of the shock-absorbing member and the outsole; and an upper edge of the roll-up portion of the soft member is lower than those of the shock-absorbing member and the outsole.

In this case, the soft member will be accommodated in the accommodating portion of the outsole.

Preferably, a tread portion having the tread surface of the outsole has a greater thickness than the roll-up portions of the outsole that are rolled up upward.

In this case, the lightweightness and the endurance will both improve.

Preferably, a transparency of the outsole is greater than a transparency of the shock-absorbing member, and the outsole is transparent or semi-transparent.

In this case, it may possibly be possible to recognize the soft member through the outsole, creating the design variety.

Herein, transparency is the measure of transparentness of a substance or a material, and the degree of transparentness may be expressed by the light transmittance.

As the method for measuring transparency, it is possible to measure transparency by using a haze meter, or the like. Specifically, a test piece can be cut out from a shoe and re-molded as necessary so as to measure the transparency referring to JIS K 7136 (plastics—determination of haze of transparent materials).

Preferably, the soft member is a foam body.

With a foam body soft member, it is easy to obtain a low-hardness soft member. Moreover, a foam body soft member will suppress an increase in the weight of the shoe sole.

Preferably, the outsole and the soft member are arranged at least on a lateral side of a rear foot portion; and a volume of the soft member arranged on a medial side of the rear foot portion is smaller than the soft member on the lateral side, or the soft member is absent (not provided) on the medial side.

In this case, impact from the first strike upon landing is likely to be absorbed, and pronation can be suppressed.

Preferably, the shock-absorbing member N has a weight per unit volume of 0.05 to 0.3 and an Asker C hardness of 46° to 65°; and the soft member S has a weight per unit volume of 0.5 to 1.2 and an Asker C hardness of 20° to 45°.

The specific gravity of the shock-absorbing member N used as a midsole is typically about 0.05 to 0.3. In contrast, by setting the specific gravity of the soft member S to 0.5 or more, the volume change rate $\Delta V/P$ becomes significantly lower than the shock-absorbing member N whose specific gravity is 0.3 or less, and it is possible to easily obtain the jelly-form soft member S having a low volume change rate $\Delta V/P$.

On the other hand, the shock-absorbing member N having a small specific gravity as described above suppresses an increase in the weight of the sole as a whole.

Note that when the soft member S is a non-foam body, the specific gravity of the soft member S may be about 1.2.

In still another aspect, a shoe of the present invention includes:

a shock-absorbing member N formed from a foam body including a thermoplastic resin component;

a solid-form soft member S including a polymer resin component, having a greater weight per unit volume than the shock-absorbing member N, having a lower hardness than the shock-absorbing member N, and having a smaller volume change per unit volume, than the shock-absorbing member N, for a change in external pressure within a predetermined range of external pressure; and an outsole 4 including a thermoplastic resin component and having a tread surface 4S, the outsole 4 being rolled up upward along at least a part of an outer edge thereof, thereby defining an accommodating portion 4A configured to accommodate the soft member S between the outsole 4 and the lid 1, wherein:

the shock-absorbing member N forms the lid 1 configured to lid the soft member S from a side of an upper; and the soft member S is wrapped in the accommodating portion 4A while being in contact with at least a part of inner surfaces Nf and 4*f* of the shock-absorbing member N and the outsole 4.

In this case, unlike Kraeuter, et al., a high cushioning property will be exerted while maintaining the lightweightness because of both the shock-absorbing member N and the soft member S arranged under the upper.

Particularly, as the outsole is rolled up upward along at least a part of the outer edge of the shoe sole, the accommodating portion for the soft member S can be provided along the outer edge. This may achieve a high cushioning property because of the soft member S that is arranged along the outer edge of the shoe sole, which arrangement is not possible with the structure of Friton, supra.

Preferably, the shock-absorbing member, the soft member and the outsole are provided over at least a part of a rear foot portion;

the first attachment area is arranged on a central portion between a medial side and a lateral side of the rear foot portion, and the second attachment area is arranged on at least one of a side surface on the medial side and a side surface on the lateral side of the rear foot portion of the shock-absorbing member; and the soft member is arranged in an area between the first attachment area arranged on the central portion and the second attachment area arranged on the side surface.

In the case of this example, with the first attachment area provided on the central portion of the rear foot portion and the second attachment area provided on the medial and lateral side surfaces of the rear foot portion, it is possible to reduce the continuous volume of the soft member, and thus to suppress excessive deformation of the soft member. With the provision of these attachment areas, the soft member can be arranged on the outer edge of the shoe sole. Therefore, it will be possible to absorb the impact from the first strike upon landing on the rear foot portion, for example.

Preferably, the soft member is secured to the inner surface of the outsole. In this case, the soft member is supported cantilevered as described above on the inner surface of the outsole.

Preferably, the shock-absorbing member N and the soft member S are arranged between the upper 2 and the outsole 4.

"The shock-absorbing member and the soft member are arranged between the upper and the outsole" means that the shock-absorbing member or the soft member does not include a sock liner arranged in the upper or an insole being a part of the upper.

In the configurations set forth above, the Asker C hardness of the soft member S may be 20° to 55°, instead of 20° to 45°. When the Asker C hardness is over 45° and 55° or less, the soft member S may function as a high-resilience material.

In the configurations set forth above, instead of the hardness of the soft member S being lower than the hardness of the shock-absorbing member N, the hardness of the soft member S may be less than or equal to the hardness of the shock-absorbing member N. That is, the hardness of the soft member S may be smaller than the hardness of the shock-absorbing member N or may be substantially equal to the hardness of the shock-absorbing member N.

Being substantially equal as used herein includes a ±5° range, preferably includes a ±3° range, and most preferably includes a ±2° range. When they have a substantially equal hardness, it may be possible to improve the stability.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Embodiments

Embodiments of the present invention will now be described with reference to the drawings.

FIG. 1A to FIG. 8E show Embodiment 1.

As shown in FIG. 1A and FIG. 1B, the shoe sole includes a first outsole 4, a shock-absorbing member N and a soft member S. As clearly shown in FIG. 2A to FIG. 3B, the shock-absorbing member N forms a lid 1 in this example.

Figure 2B:
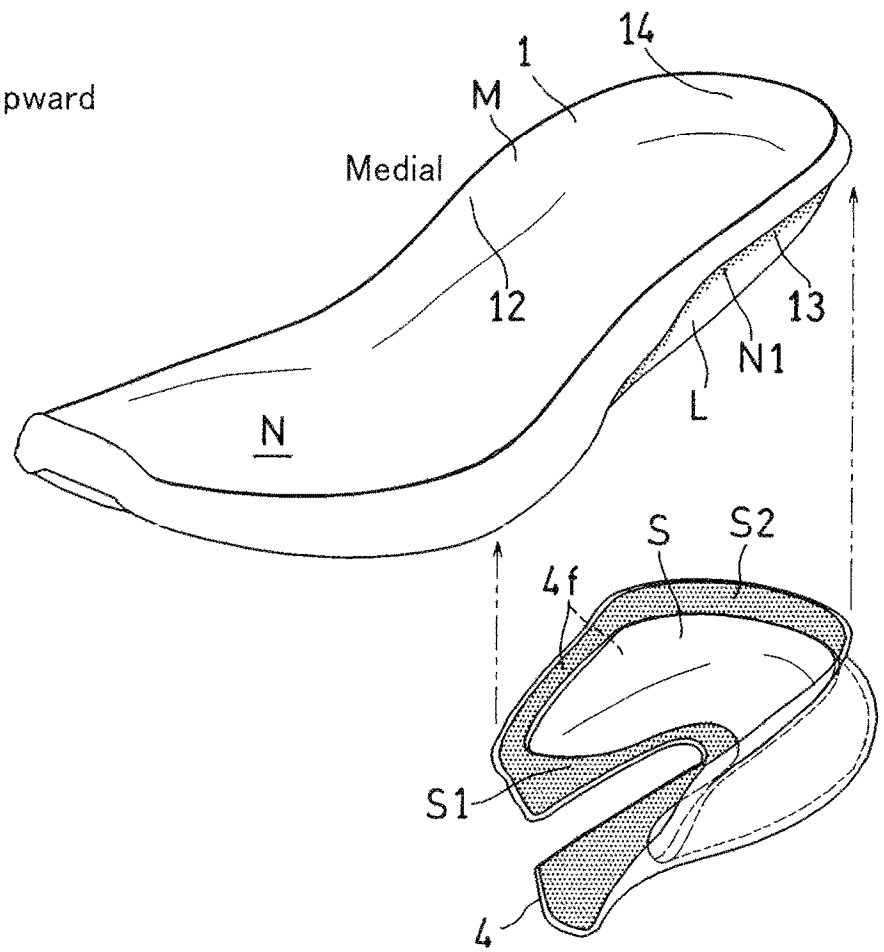
FIG. 2A and FIG. 2B are schematic exploded perspective views, of Embodiment 1, similar to FIG. 1A and FIG. 1B.
Figure 2A:
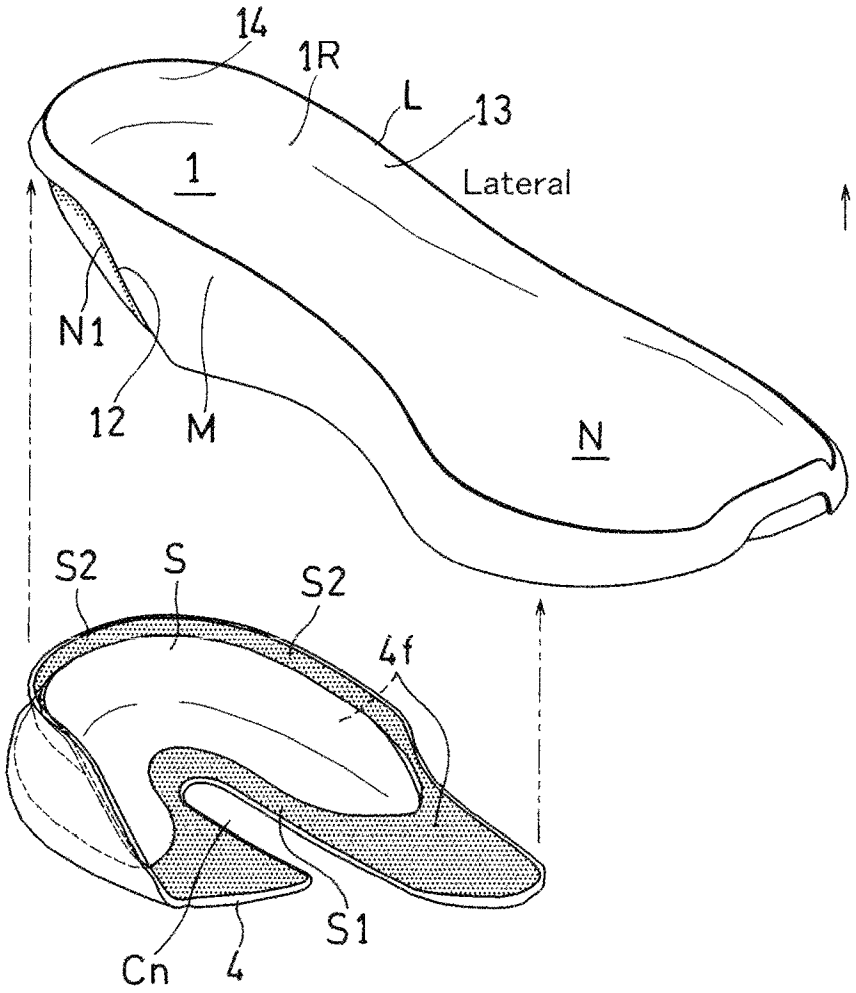

In FIG. 2A, the shock-absorbing member N is formed from a foam body, e.g., EVA, having a thermoplastic resin component. That is, the shock-absorbing member N is formed from a material that is commonly called a midsole material, and forms a midsole.

Figure 12A:
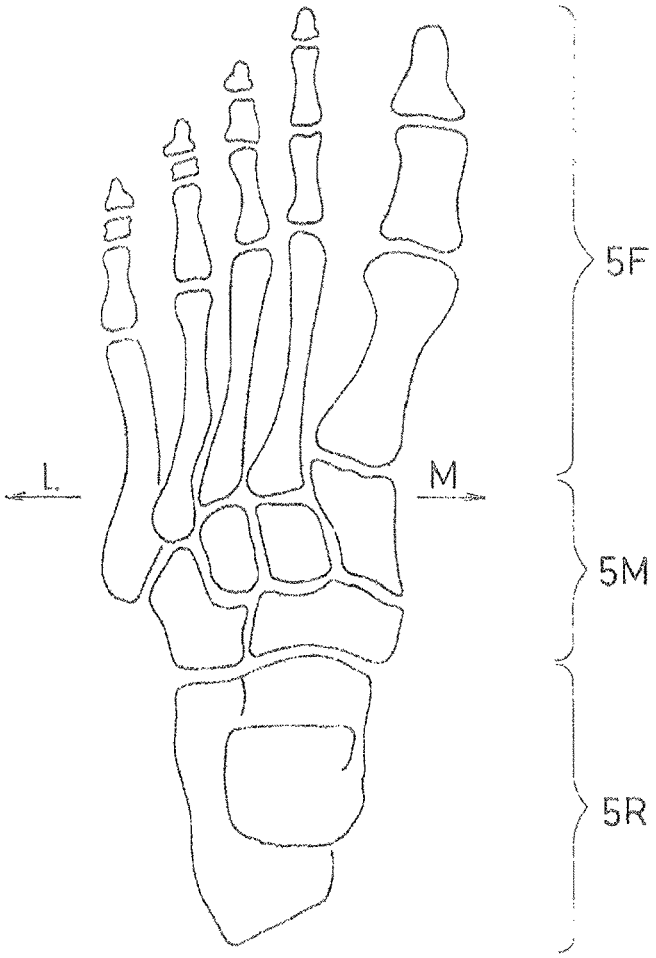
FIG. 12A and FIG. 12B are a plan view and a lateral side view, respectively, showing the foot bone structure.
Figure 12B:
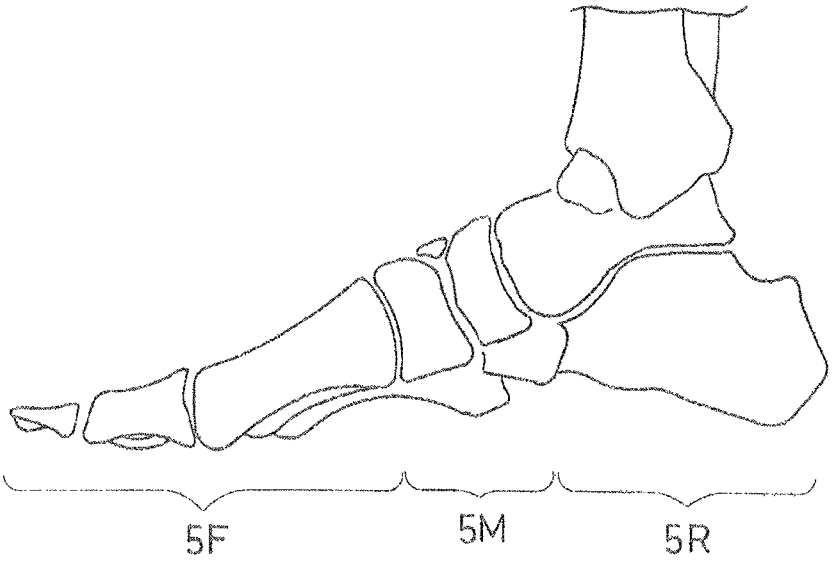

The shock-absorbing member N includes a forefoot portion 1F, a middle foot portion 1M and a rear foot portion 1R of FIG. 1A that conform to a forefoot section 5F, a middle foot section 5M and a rear foot section 5R of the foot shown in FIG. 12A and FIG. 12B, and supports the entirety of the sole of the foot.

In FIG. 12A and FIG. 12B, the forefoot section 5F includes five metatarsal bones and fourteen phalanges. The middle foot section 5M includes a navicular bone, a cuboid bone and three cuneiform bones. The rear foot section 5R includes a talus bone and a calcaneal bone.

In FIG. 1A, in this example, the soft member S is arranged in rear foot portion 1R. The soft member S includes a polymer resin component, and is a solid-form and jelly-form viscoelastic material. In this example, the soft member S may be a foam body that includes a thermoplastic resin component and includes polystyrene, for example, as its primary component.

Figure 8A:
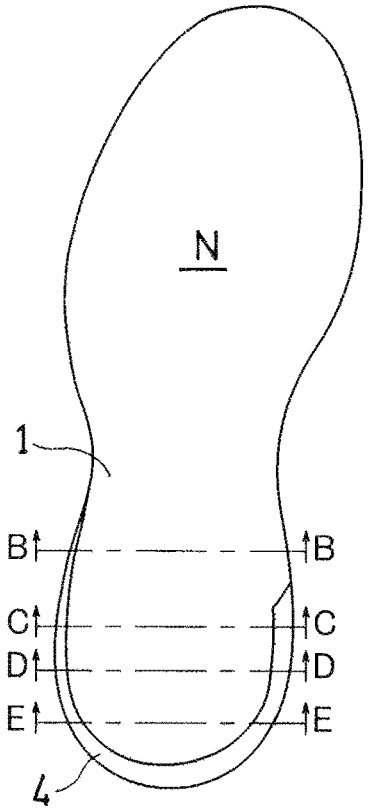
FIG. 8A is a schematic plan view showing the shoe sole.
Figure 8B:
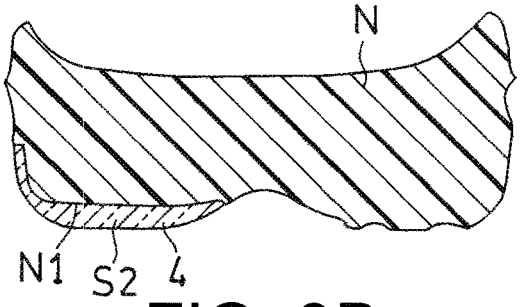
FIG. 8B, FIG. 8C, FIG. 8D and FIG. 8E are cross-sectional views taken along line B-B, line C-C, line D-D and line E-E of FIG. 8A, respectively.
Figure 8C:
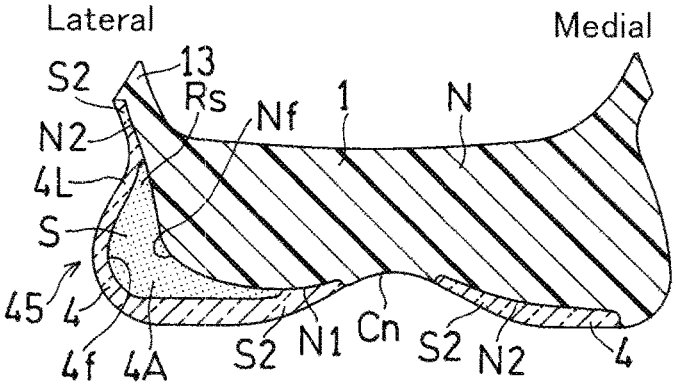
Figure 8D:
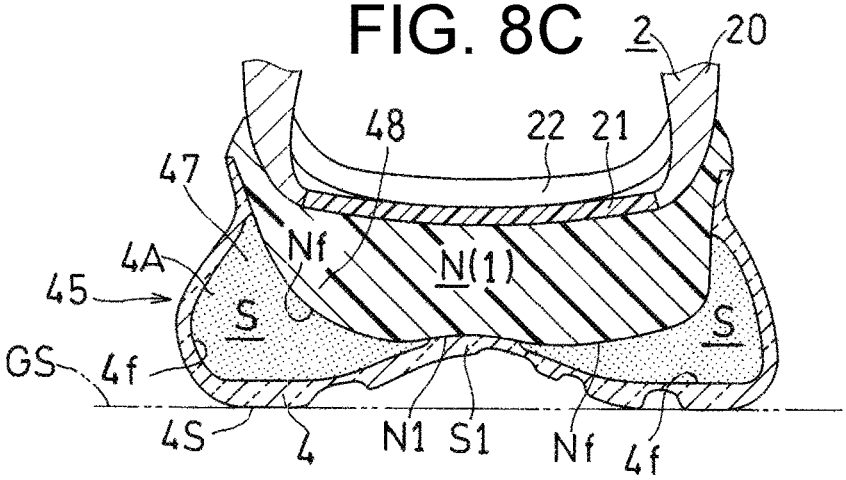

The first outsole 4 of FIG. 1A may include a thermoplastic resin component, may include polyurethane, for example, as its primary component, and may be semi-transparent. As shown in FIG. 8D, the first outsole 4 has a tread surface 4S. Herein, the tread surface 4S means a surface that is in contact with the flat and hard road surface GS of FIG. 8D under no load or in a standstill position.

Figure 8E:
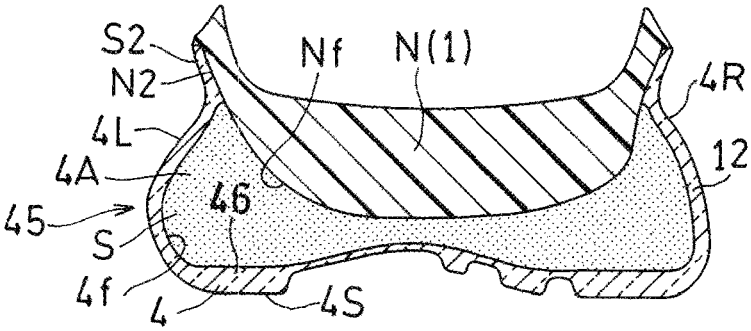

The first outsole 4 of FIG. 1A includes roll-up portions 4L, 4M and 4R continuously extending along the outer edge of the rear foot portion 1R of the shock-absorbing member N, wherein the roll-up portions 4L, 4M and 4R are rolled up upward along the outer edge. As shown in FIG. 8C to FIG. 8E, the first outsole 4 defines an accommodating portion 4A for the soft member S between the first outsole 4 and the lid 1 (the shock-absorbing member N). The lid 1 lids the accommodating portion 4A and covers the soft member S from the side of the upper 2.

Figures 3A, 3B:
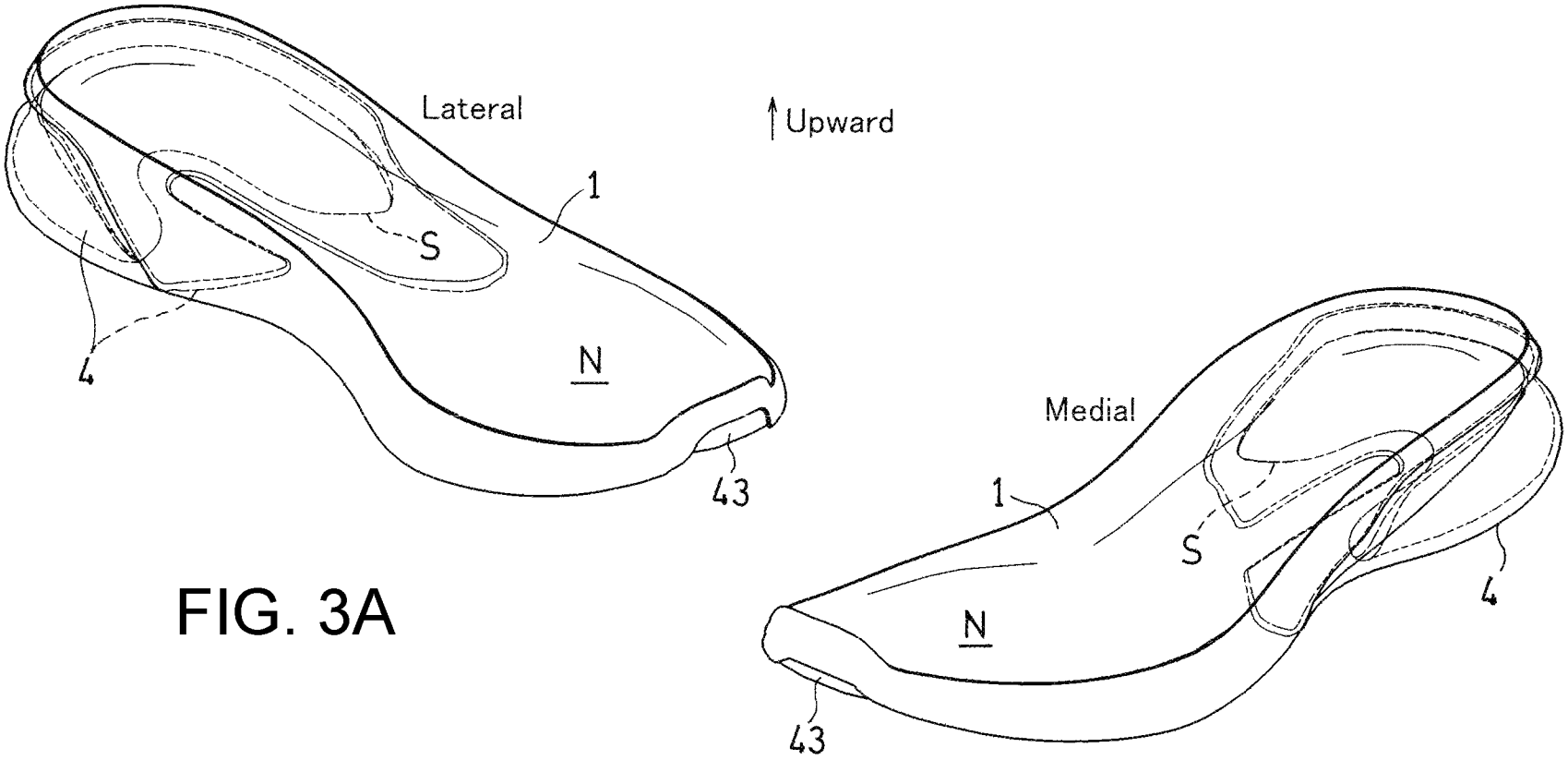
FIG. 3A and FIG. 3B are schematic perspective views showing the shoe sole of Embodiment 1 as seen from an upper-medial diagonal direction and an upper-lateral diagonal direction, respectively.

As shown in FIG. 3A and FIG. 3B, the shock-absorbing member N, the soft member S and the first outsole 4 are attached together to form a shoe sole, and bonded to the upper 2 of FIG. 8D. That is, the shock-absorbing member N of the midsole is bonded to the outer surface of an insole 21 and an instep member 20, which are parts of the upper 2. The instep member 20 covers the upper surface of the instep or the medial and lateral side surfaces of the foot. The insole 21 is configured to be continuous with the instep member 20 and conform to the sole of the foot.

The shock-absorbing member N and the soft member S are arranged between the upper 2 including the insole 21 and the first outsole 4. That is, the shock-absorbing member N and the soft member S are arranged on the outer side of the upper 2 including the insole 21. Note that a sock liner 22 is arranged on the insole 21 of the upper 2.

The soft member S of FIG. 8D is wrapped in the accommodating portion 4A by the shock-absorbing member N and the first outsole 4 while being in contact with inner surfaces Nf and 4*f* of the shock-absorbing member N and the first outsole 4. That is, the accommodating portion 4A, which is formed by the shock-absorbing member N and the first outsole 4, is filled with the soft member S with no space remaining.

Figure 7A:
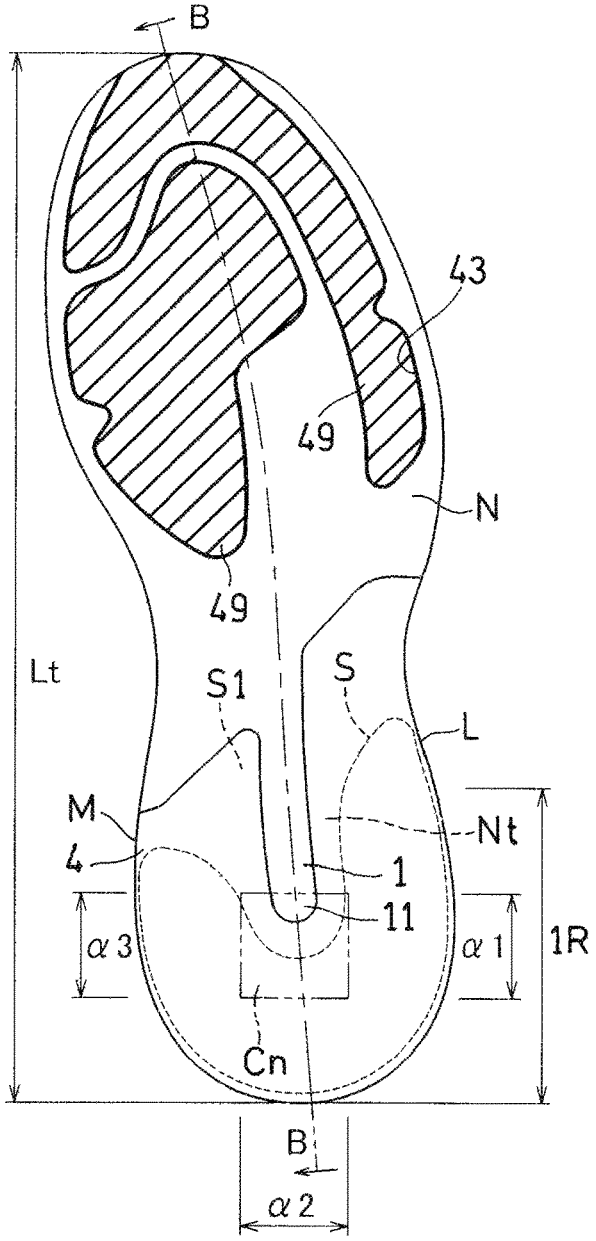
FIG. 7A, FIG. 7B, FIG. 7C and FIG. 7D are a schematic bottom view showing the shoe sole, a cross-sectional view thereof taken along line B-B of FIG. 7A, a back view thereof, and an enlarged cross-sectional view of the rear foot portion, respectively.
Figure 7B:
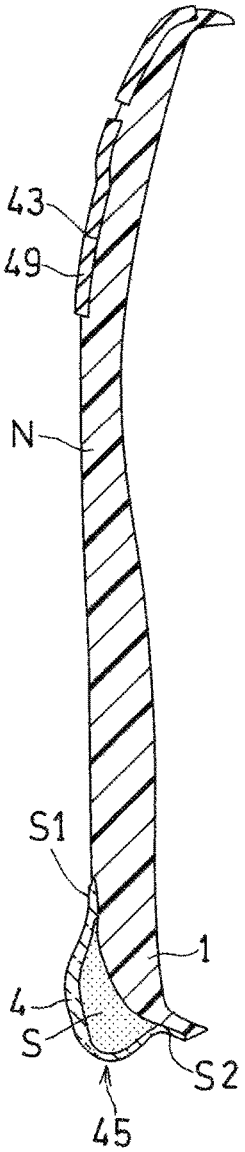
Figure 7C:
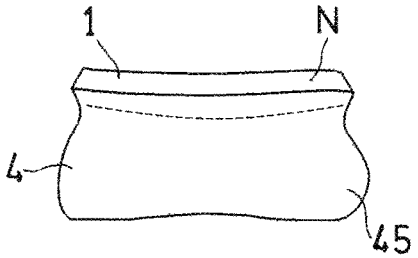

As shown in FIG. 7A and FIG. 7B, a second outsole 49 made of a rubber, for example, is arranged on the forefoot portion of the shock-absorbing member N. The second outsole 49 is fitted into a depressed portion 43 of the forefoot section of the shock-absorbing member N. Note that the surface and the cross section of the rubber-made second outsole 49 are hatched.

The first and second outsoles 4 and 49 are tread soles that have a greater wear resistance than the shock-absorbing member N, and typically has a higher hardness than the shock-absorbing member N. The second outsole 49 is typically formed from a rubber foam body or a rubber non-foam body, whereas the first outsole 4 is formed from a polyurethane non-foam body.

Next, exemplary physical properties of the shock-absorbing member N and the soft member S will be described.

The shock-absorbing member N is a foam body of EVA, for example, and is configured to have a specific gravity of 0.1 to 0.3 and an Asker C hardness of about 46° to 65°.

On the other hand, the soft member S is a foam body or a non-foam body of polystyrene, etc., for example, and is configured to have a specific gravity of 0.5-1.2 and an Asker C hardness of 20°-45°. In the case of this example, the soft member S may be a jelly-form solid viscoelastic material, with a large amount of a plasticizer, for example, added thereto. Such a soft member S has a lower volume change rate ΔV/P per unit volume than the shock-absorbing member N, as described above.

Figure 10A:
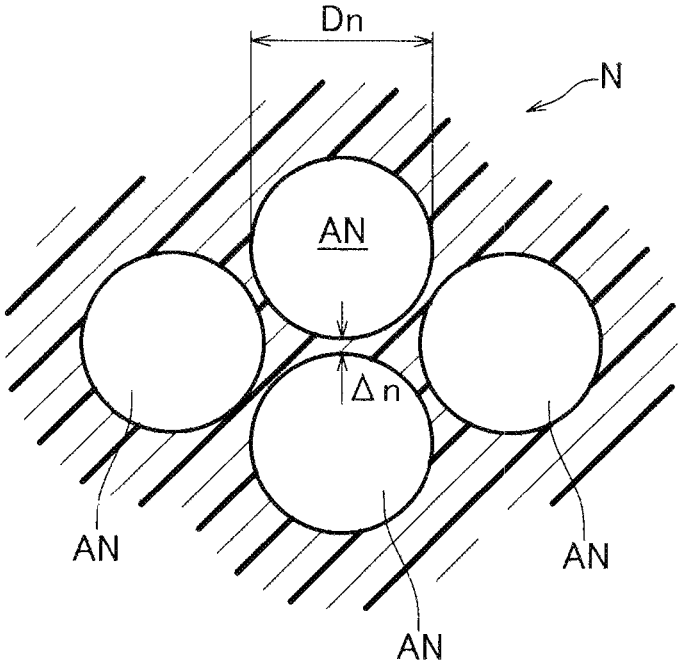
FIG. 10A and FIG. 10B are schematic enlarged cross-sectional views showing, on an enlarged scale, foam bodies, which are an example shock-absorbing member and an example soft member, respectively.
Figure 10B:
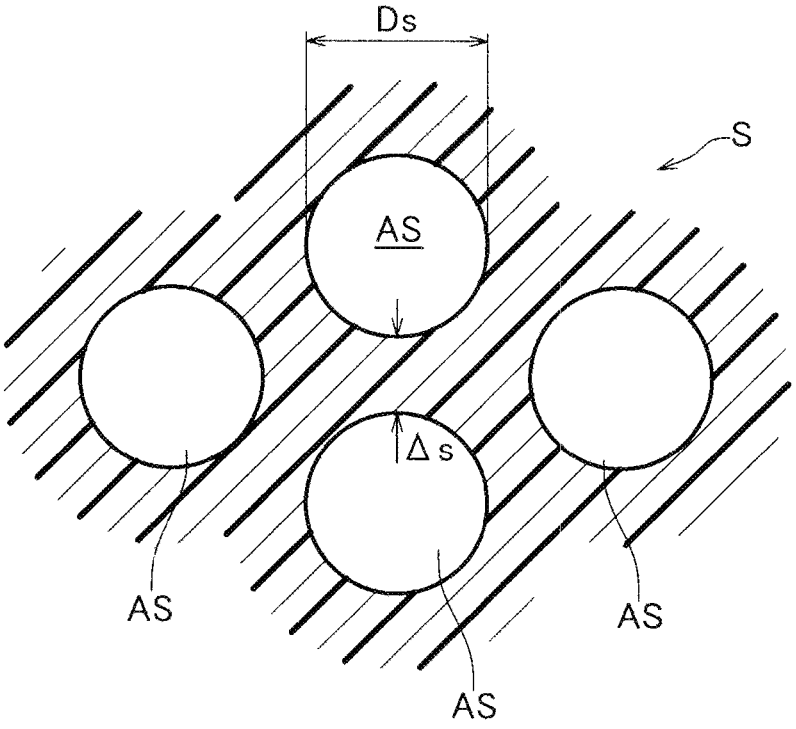

FIG. 10A shows an enlarged conceptual cross section of the soft member S, whereas FIG. 10B shows an enlarged conceptual cross section of the shock-absorbing member N. In FIG. 10A and FIG. 10B, the ratio of the bubble diameter Ds, Dn with respect to the distance Δs, Δn between bubbles AS, AN is greater for the shock-absorbing member N than for the soft member S, as represented by Expression (1) below.

$$Ds/\Delta s < Dn/\Delta n \quad (1)$$

That is, the value corresponding to the microscopic slenderness ratio is greater for the shock-absorbing member N than for the soft member S. Herein, when the slenderness ratio is equal to or greater than a certain ratio, a structure buckles even under a stress that is less than or equal to the elastic limit. Therefore, it is more likely to buckle when the expansion ratio of the soft member S and the shock-absorbing member N of the present invention is greater. In other words, the member S, N has a higher volume change rate ΔV/P as the specific gravity thereof is smaller. On the other hand, the member S, N has a lower volume change rate ΔV/P as the specific gravity thereof is larger.

Next, specific structures of the first outsole 4, the shock-absorbing member N and the soft member S of this example of FIG. 1A to FIG. 8E will be described.

The soft member S of FIG. 2A and FIG. 2B may be bonded or welded to the inner surface 4*f* of the first outsole 4, or does not need to be secured to the first outsole 4. The inner surface 4*f* of the first outsole 4 has first and second attachment areas S1 and S2 formed in a three-dimensional loop shape along an entire circumferential edge of the soft member S, wherein the three-dimensional loop shape is slightly larger than the soft member S. The first and second attachment areas S1 and S2 are planar and band-shaped surfaces that are attached to the surface of the shock-absorbing member N. The attachment areas S1 and S2 do not need to seal the accommodating portion 4A of FIG. 8D, and are only required to be attached to the shock-absorbing member N to such a degree that foreign substances do not enter the accommodating portion 4A.

The first attachment area S1 of FIG. 2A is arranged so as to conform to at least the central portion Cn, and the vicinity thereof, between the medial side M and the lateral side L of the rear foot portion 1R of the shock-absorbing member N of FIG. 7A. The second attachment area S2 of FIG. 2A and FIG. 2B is arranged so as to conform to roll-up portions 12, 13 and 14 of the medial portion, the lateral portion and the back portion of the rear foot portion 1R of the shock-absorbing member N. The soft member S is arranged in the area between the first attachment area S1 and the second attachment area S2 of FIG. 2A. The first and second attachment areas S1 and S2 are provided over the majority of the portion of the inner surface 4*f* of the first outsole 4; the portion is not in contact with the soft member S and does not cover the soft member S.

Figures 4A, 4B:
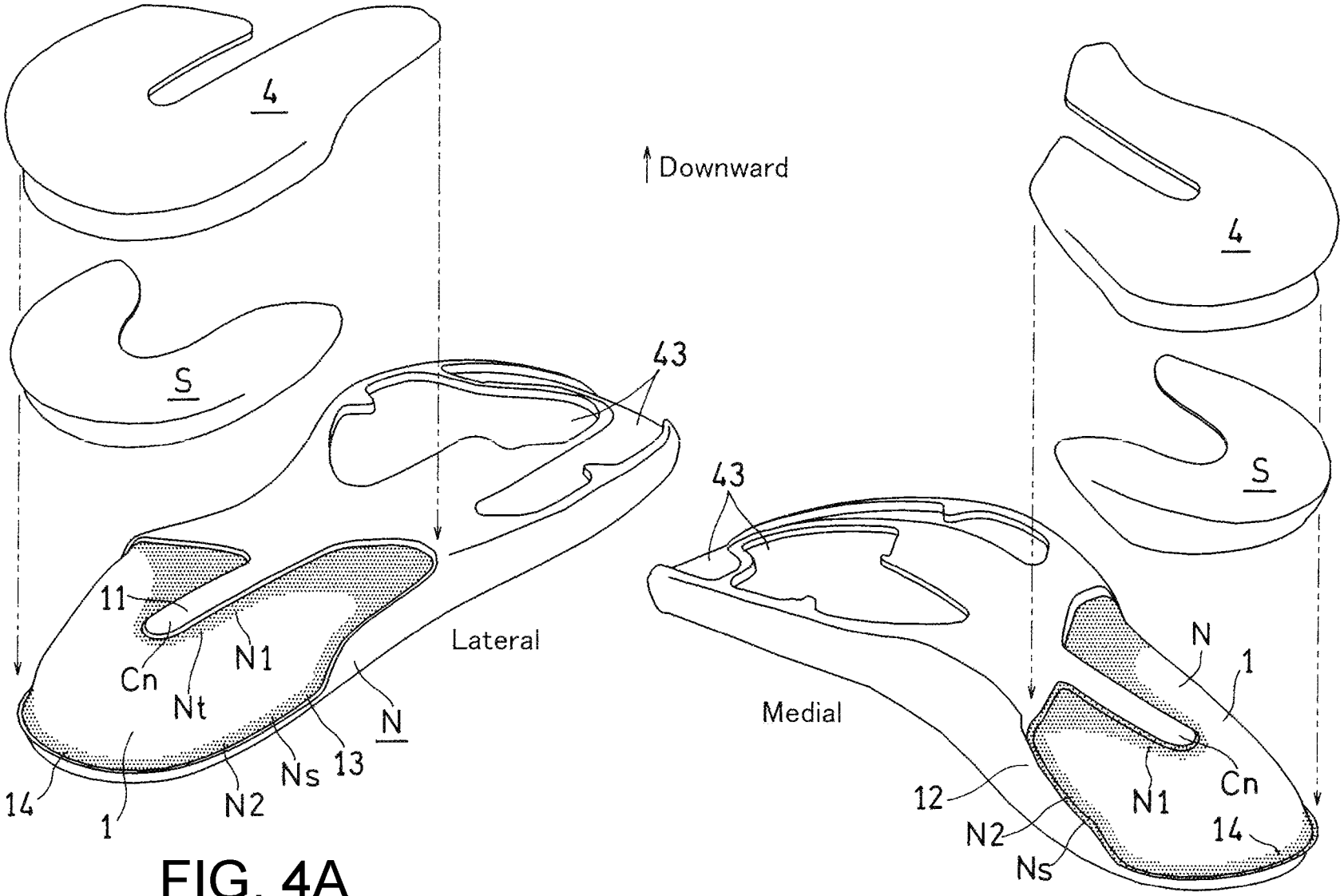
FIG. 4A and FIG. 4B are schematic exploded perspective views showing the tread surface side of the shoe sole of Embodiment 1 as seen from the lateral side and the medial side, respectively.
Figures 5A, 5B:
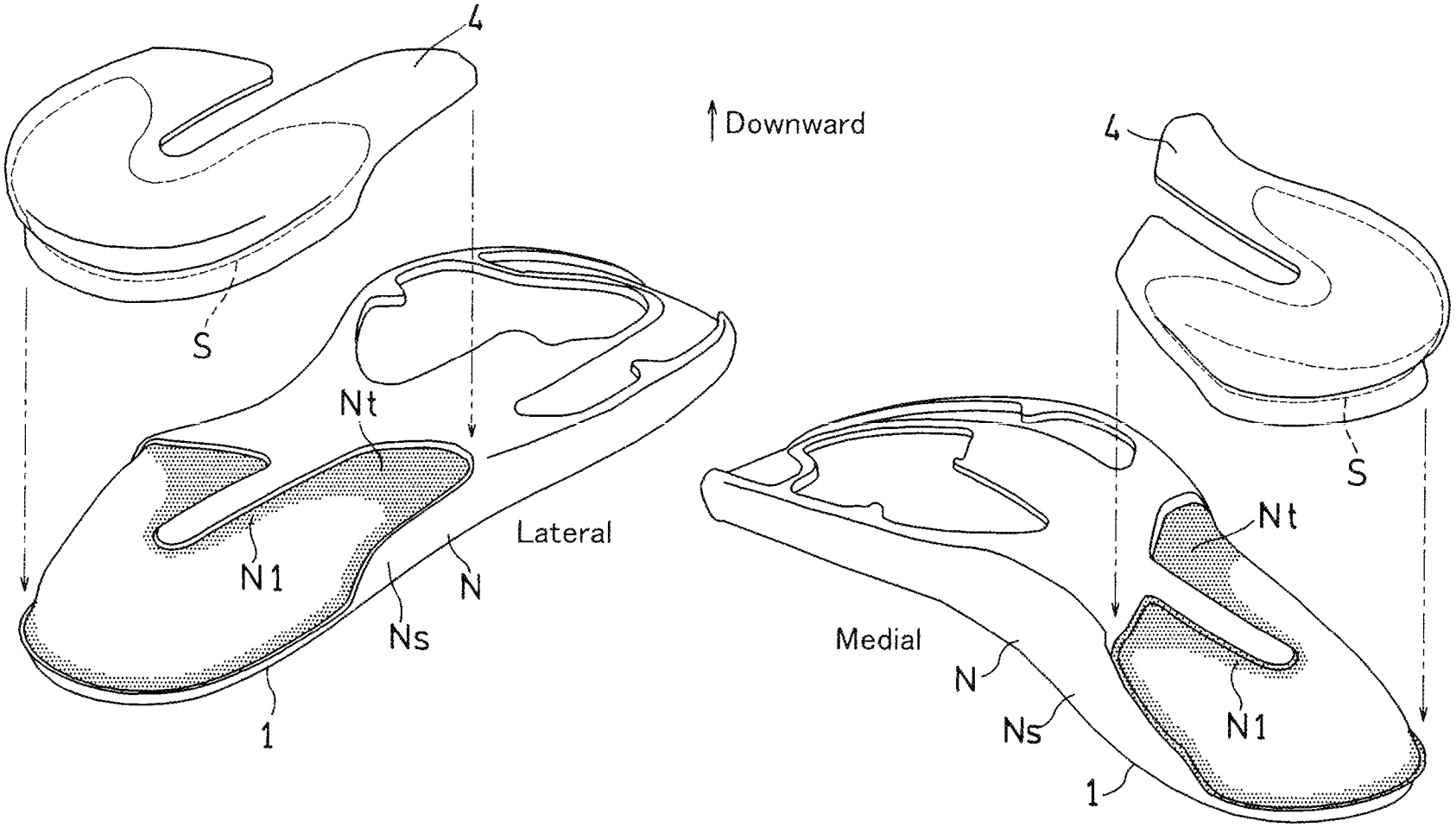
FIG. 5A and FIG. 5B are schematic exploded perspective views, of Embodiment 1, similar to FIG. 4A and FIG. 4B.
Figures 6A, 6B:
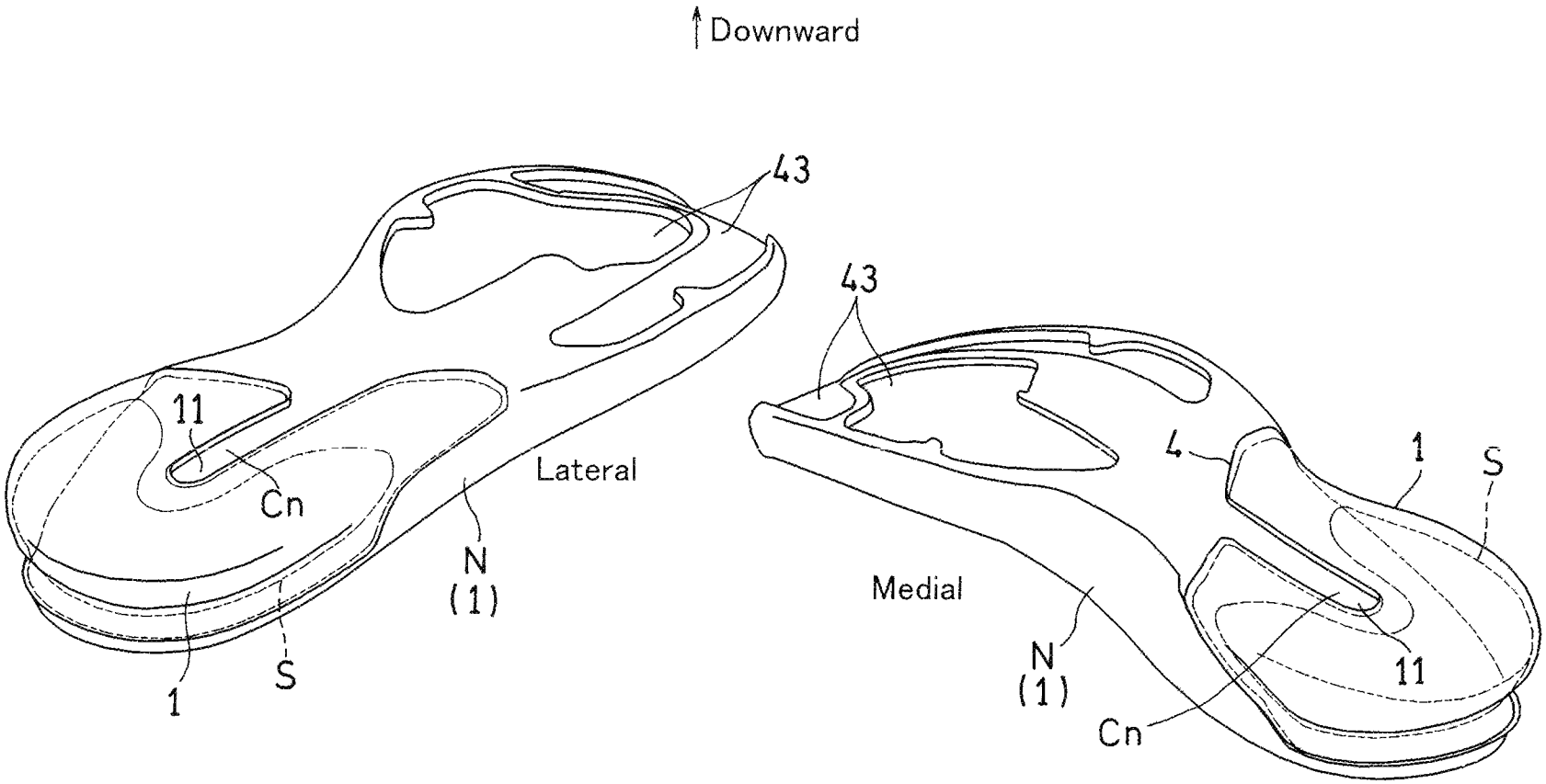
FIG. 6A and FIG. 6B are schematic perspective views showing the tread surface side of the shoe sole of Embodiment 1 as seen from the lateral side and the medial side, respectively.

The first and second attachment areas S1 and S2 of FIG. 2A are bonded to first and second attached areas N1 and N2 of the shock-absorbing member N of FIG. 4A and FIG. 4B. The first attached area N1 is arranged on at least a portion of the central portion Cn of the shock-absorbing member N. On the other hand, the second attached area N2 is arranged on the roll-up portions 12, 13 and 14 of the medial portion, the lateral portion and the back portion of the shock-absorbing member N.

Herein, the central portion Cn of the rear foot portion includes the overlap between the central ⅓ area α1 of the three equal parts into which the rear foot portion 1R is divided in the front-rear direction and the central ⅓ area α2 of the three equal parts into which the rear foot portion 1R is divided in the medial-lateral direction, as indicated by a two-dot-chain line of FIG. 7A. The central portion Cn of the rear foot portion includes the overlap between the central ⅓ area α2 and the area α3 that is 10% to 20% from the rear end of the shoe sole with respect to the total length Lt of the shoe sole.

In at least a portion of the central portion Cn, the first attachment area S1 is attached to the bottom surface Nt of the shock-absorbing member N (the lid 1) of FIG. 4A. This controls the continuity of deformation of the soft member S. The second attachment area S2 of FIG. 2A is attached to the side surface Ns of the shock-absorbing member N (the lid 1) of FIG. 4A.

In the case of this example, in a portion of the central portion Cn of FIG. 7A, the lid 1, which is the shock-absorbing member N, has an exposed portion 11 that is exposed without being covered by the first outsole 4. The exposed portion 11 extends in the front-rear direction of the foot. That is, in the central portion Cn, the edge of the first outsole 4 extends in the front-rear direction.

As shown in FIG. 7B to FIG. 7D and FIG. 8C to FIG. 8E, the first outsole 4 and the soft member S have a skirt-shaped curved portion 45 that flares into a skirt shape and outwardly protrudes along a part or whole of the outer edge of the rear foot portion.

The skirt-shaped curved portion 45 of the first outsole 4 forms an undercut. The undercut means a protruding shape or a depressed shape that, when removing the first outsole 4 from the mold, cannot, as it is, be released from the mold. The undercut defines a first portion 47 of FIG. 8D. The soft member S enters the first portion 47. The soft member S fills the first portion 47. The first outsole 4 and the soft member S define a second portion 48 and also define a depressed surface. The shock-absorbing member N having a downwardly-protruding surface is fitted into the second portion 48.

Figure 7D:
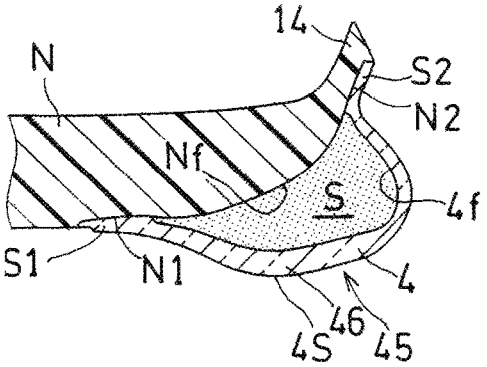

On the rear end of the rear foot portion of FIG. 7D and the medial side and the lateral side of FIG. 8C to FIG. 8E, the inner surface 4*f* of the skirt-shaped curved portion 45 of the first outsole 4 has a depressed surface. On the other hand, the inner surface Nf of the shock-absorbing member N has a protruding surface protruding toward the first outsole 4.

In the case of this example, the first outsole 4, the soft member S and the shock-absorbing member N lie on each other in the up-down direction (in the vertical direction) on the longitudinal cross section of FIG. 7D and/or the transverse cross section of FIG. 8D, for example.

In the case of this example, the first outsole 4, the soft member S and the shock-absorbing member N lie on each other in the front-rear direction or the horizontal direction respectively on the longitudinal cross section of FIG. 7D or the transverse cross section of FIG. 8D, for example.

That is, the soft member S of FIG. 8D includes a portion that is arranged under the shock-absorbing member N, a portion that is arranged on the side of the shock-absorbing member N, and a portion that is arranged diagonally below the shock-absorbing member N.

In FIG. 8C, the soft member S, the outsole 4 and the shock-absorbing member N each have a roll-up portion that is rolled up upward along at least a part of the outer edge of the shoe sole. The roll-up portion Rs of the soft member S extends along the roll-up portion 13 of the shock-absorbing member N (the lid 1) and the roll-up portions 4L, 4M and 4R of the outsole 4 of FIG. 1A. The position of the upper edge of the roll-up portion Rs of the soft member S of FIG. 8C is lower than that of the shock-absorbing member N and the outsole 4.

In the case of this example, as is clearly shown in FIG. 8C and FIG. 7A, the lateral side L of the soft member S and the first outsole 4 extends forward relative to the medial side M. Therefore, the lateral side L, which receives the first strike, will have a high cushioning property.

Now, the surface of the soft member S of FIG. 1A may be bonded via an adhesive, or welded during the manufacture, to the first outsole 4 and the shock-absorbing member N of FIG. 4A. Note that ribs may be provided on the first outsole 4.

As shown in FIG. 7D and FIG. 8E, a tread portion 46 having the tread surface 4S of the outsole 4 has a greater thickness than the roll-up portions 4L, 4M and 4R (FIG. 1A) of the outsole 4 that are rolled up upward. The transparency of the outsole 4 is greater than the transparency of the shock-absorbing member N, and the outsole 4 is semi-transparent.

FIG. 13A to FIG. 13D show other examples.

Figure 13A:
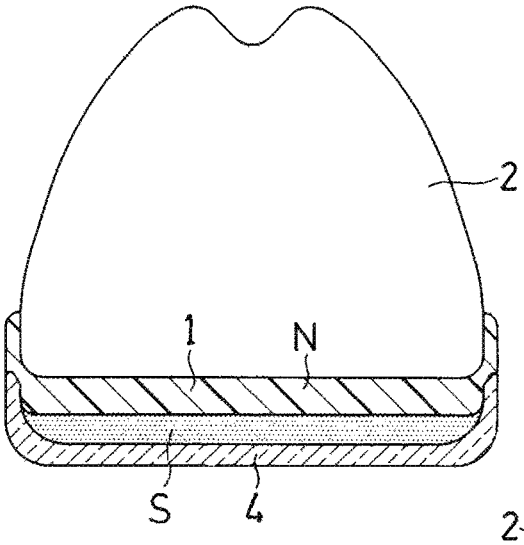
FIG. 13A, FIG. 13B, FIG. 13C and FIG. 13D are transverse cross-sectional views of a shoe showing cross sections of shoe soles of other examples.

As shown in FIG. 13A, the first outsole 4 may include no skirt portion and no curved portion.

Figure 13B:
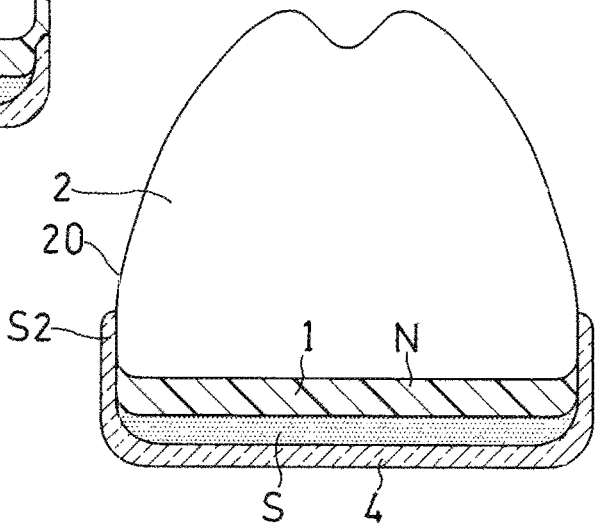

As shown in FIG. 13B, the second attachment area S2 of the first outsole 4 may be attached to the instep member 20 of the upper 2.

Figure 13C:
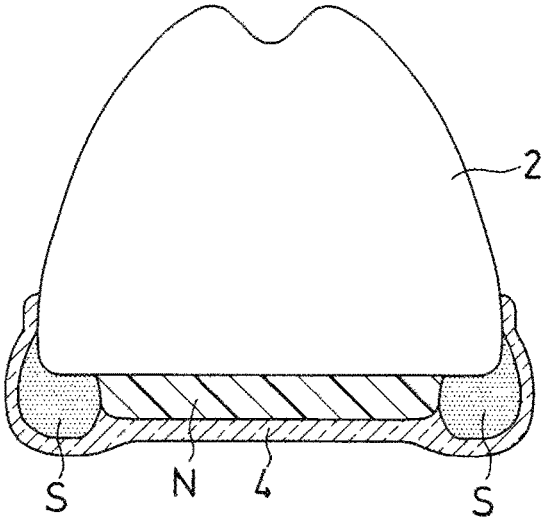

As shown in FIG. 13C, the soft member S and the shock-absorbing member N may be accommodated in the first outsole 4 while not lying on each other in the up-down direction.

Figure 13D:
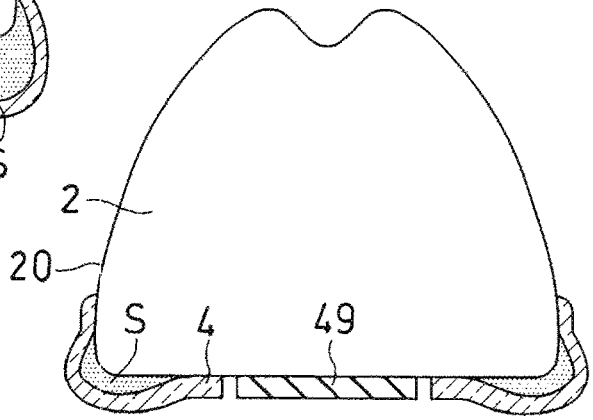

As shown in FIG. 13D, the shock-absorbing member N may be absent (not provided). In this case, the first outsole 4 may be attached to the insole (not shown) or the instep member 20 of the upper 2.

FIG. 14A to FIG. 14D show still other examples.

Figure 14A:
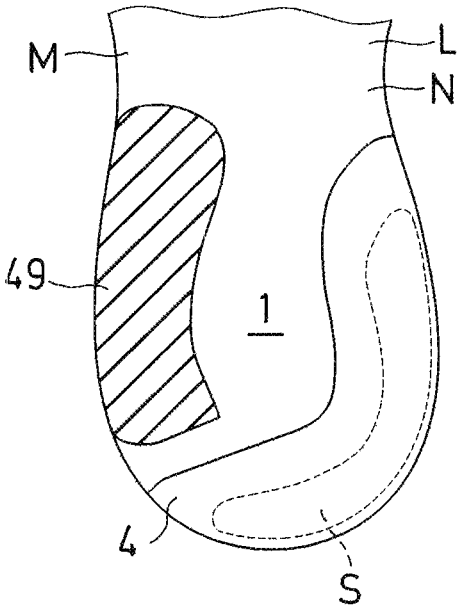
FIG. 14A, FIG. 14B, FIG. 14C and FIG. 14D are a bottom view of the rear half of a shoe sole of another example, a plan view thereof, a back view thereof, and a cross-sectional view thereof taken along line D-D of FIG. 14B, respectively.
Figure 14B:
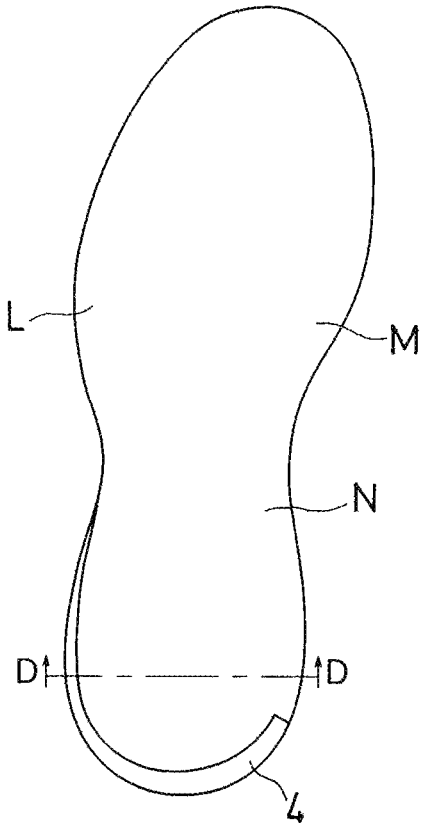
Figure 14C:
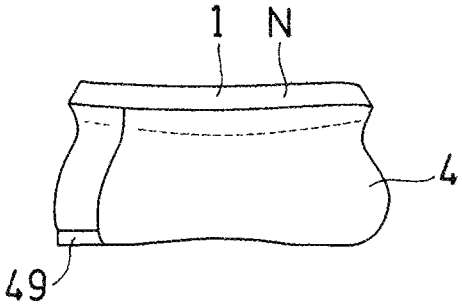
Figure 14D:
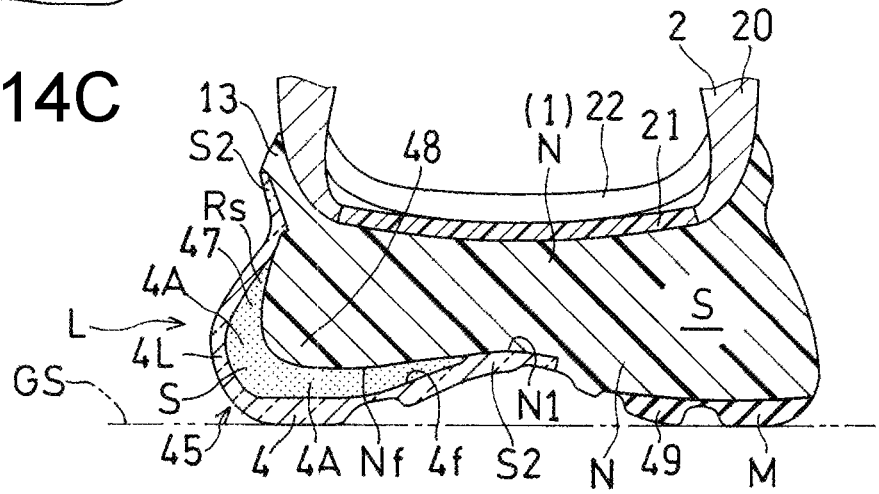
Figure 15A:
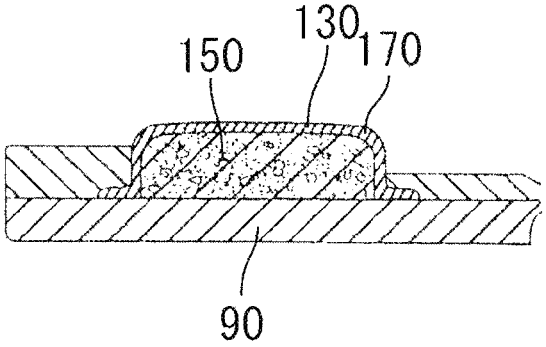
FIG. 15A PRIOR ART
FIG. 15A, FIG. 15B, FIG. 15C, FIG. 15D, FIG. 15E and FIG. 15F are cross-sectional views showing shoe soles disclosed in prior art examples.
Figure 15D:
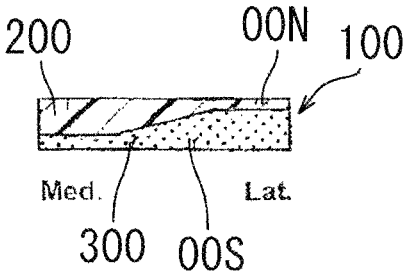
FIG. 15D PRIOR ART
Figure 15B:
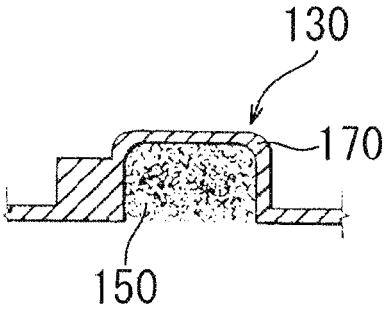
FIG. 15B PRIOR ART
Figure 15E:
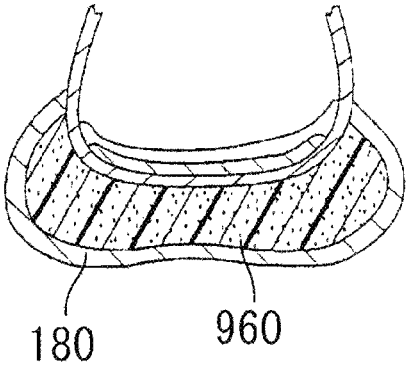
FIG. 15E PRIOR ART
Figure 15C:
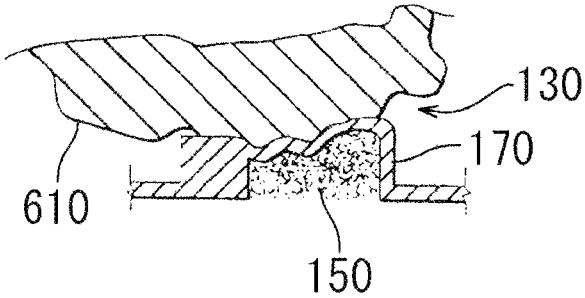
FIG. 15C PRIOR ART
Figure 15F:
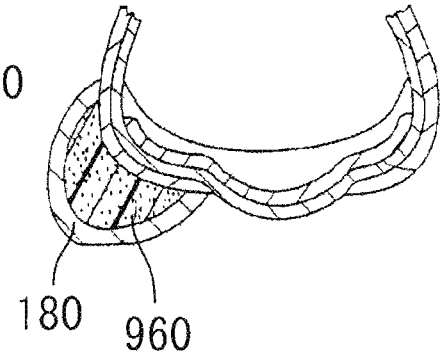
FIG. 15F PRIOR ART
Figure 16A:
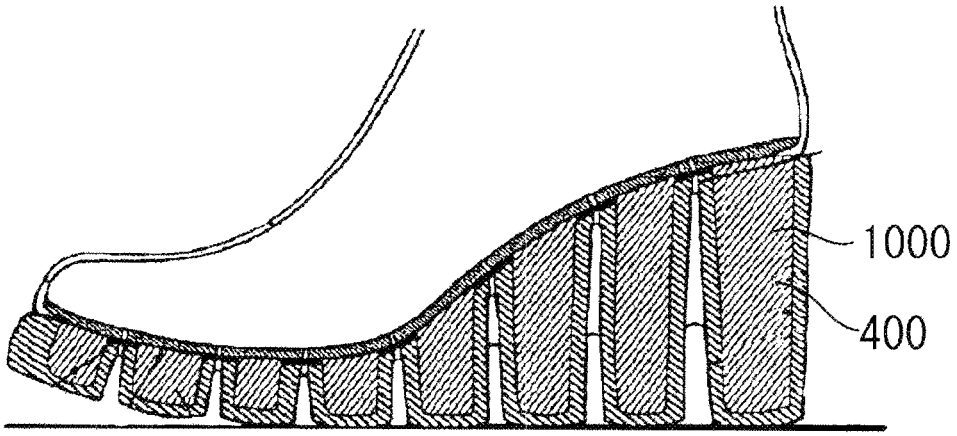
FIG. 16A PRIOR ART
FIG. 16A and FIG. 16B are cross-sectional views of a shoe and a shoe sole disclosed in other prior art examples.
Figure 16B:
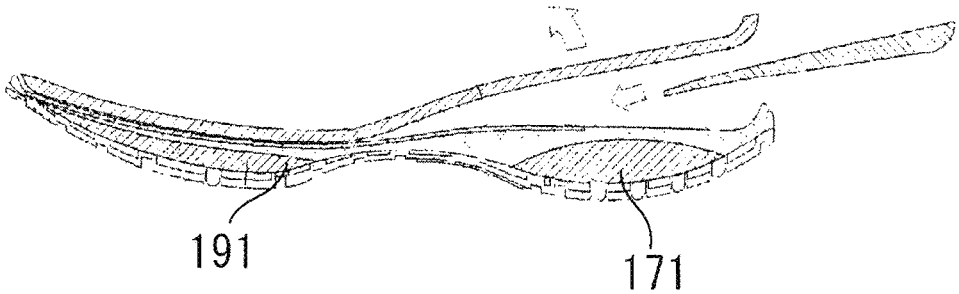
FIG. 16B PRIOR ART

In this example, as shown in the bottom view of FIG. 14A, the soft member S and the first outsole 4 are provided only on the rear end and the lateral side of the rear foot portion. Note that a second outsole 4 made of a rubber may be arranged on the medial side of the rear foot portion. The soft member S of FIG. 14D has a V-letter shape, and is arranged between the depressed surface of the first outsole 4 and the protruding surface of the midsole along a part of the outer edge of the shock-absorbing member N (midsole).

As shown in FIG. 17A to FIG. 17D, a plurality of ribs 4RI may be formed integral with the first outsole 4. These ribs 4RI have a unitary structure that is a part of, and integral with, the first outsole 4.

These ribs 4RI may extend generally in the transverse direction along the skirt-shaped curved portion 45 of the first outsole 4 from the medial side surface to the lateral side surface through the bottom surface. The ribs 4RI of FIG. 17A and FIG. 17C may extend, on the medial and lateral side surfaces, toward a lower-rear diagonal direction. In these cases, the ribs 4RI are curved similar to the skirt-shaped curved portion 45.

Figure 17C:
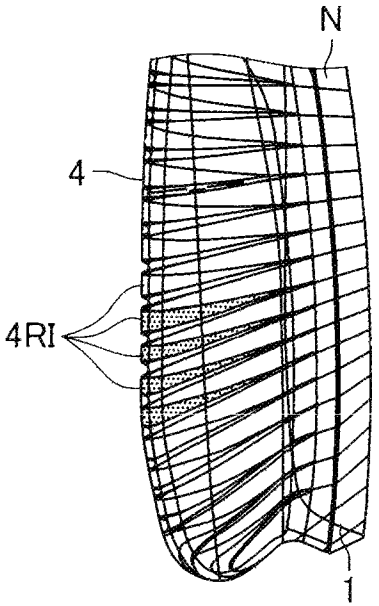
FIG. 17A, FIG. 17B, FIG. 17C and FIG. 17D are a medial side view, a bottom view, a lateral cross-sectional view and a back view, respectively, showing a case where ribs are provided on a first outsole.
Figure 17B:
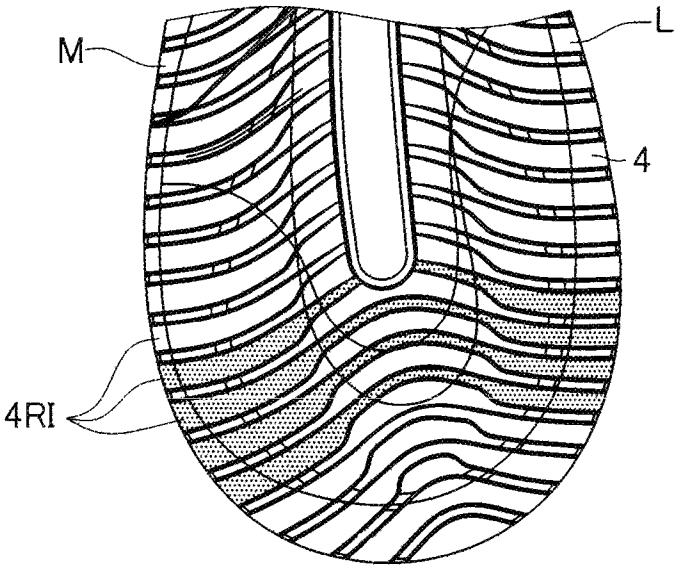
Figure 17D:
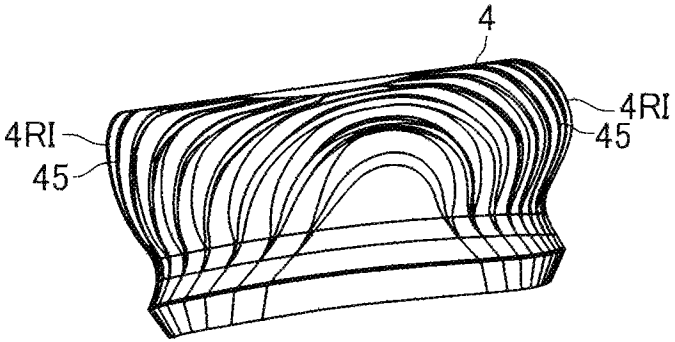
Figure 17A:
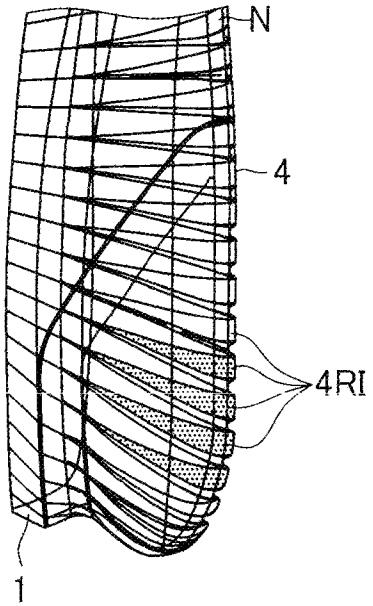

The ribs 4RI may be formed so as to protrude toward the outward direction. The plurality of ribs 4RI may be arranged generally parallel to each other as shown in FIG. 17A and FIG. 17C.

The ribs 4RI having one or more features of these structures will suppress the stretch of the skirt-shaped curved portion 45 and the first outsole 4 while suppressing an increase in the weight of these members 45 and 4.

Note that a rib-like pattern may be formed on the lid 1 and the shock-absorbing member N.

While preferred embodiments have been described above with reference to the drawings, various obvious changes and modifications will readily occur to those skilled in the art upon reading the present specification.

For example, the soft member S and the first outsole 4 may be provided not only in the rear foot portion of the shoe sole, but also in the forefoot portion and the middle foot portion thereof. These members may be provided only in the forefoot portion and/or the middle foot portion. These members may be provided on one or more of the rear end, the lateral side and the medial side of the rear foot portion.

The first outsole 4 and the soft member S, as seen from above, may be in a loop shape, as well as a J-letter shape and a U-letter shape.

Thus, such changes and modifications are deemed to fall within the scope of the present invention.

INDUSTRIAL APPLICABILITY

The present invention is applicable to structures of various shoe soles such as those for running and walking.

REFERENCE SIGNS LIST

1: Lid, 1F: Forefoot portion, 1M: Middle foot portion, 1R: Rear foot portion, 11: Exposed portion

12, 13: Roll-up portions of (shock-absorbing member) on opposite side surfaces, 14: Roll-up portion of (shock-absorbing member) on back surface

2: Upper, 20: Instep member, 21: Insole, 22: Sock liner

4: First outsole, 4A: Accommodating portion, 4L, 4M, 4R: Roll-up portion, 4S: Tread surface

40: Curved portion, 41: Skirt portion, 43: Depressed portion, 45: Skirt-shaped curved portion

46: Tread portion, 47: First portion, 48: Second portion, 49: Second outsole

5F: Forefoot section, 5M: Middle foot section, 5R: Rear foot section N: Shock-absorbing member, N1: First attached area, N2: Second attached area, Nt: Bottom surface, Ns: Side surface S: Soft member, S1: First attachment area, S2: Second attachment area M: Medial side, L: Lateral side Nf, 4*f*: Inner surface Cn: Central portion R: Back surface, Rs: Roll-up portion of soft member $\alpha$1 to $\alpha$3: Area $\sigma$, $\sigma$2: Stress, $\sigma$1: Resultant force, $\sigma$3: Component force $\Delta V/P$: Volume change rate $\delta$: Strain

The invention claimed is:

1. A shoe comprising:

a solid-form soft member including a polymer resin component and having a weight per unit volume of 0.31 to 1.2 and an Asker C hardness of 20° to 55°;

a lid configured to lid the soft member from a side of an upper; and an outsole including a thermoplastic resin component and having a tread surface, the outsole being rolled up upward along at least a part of an outer edge of the outsole, thereby defining, with the lid, an accommodating portion configured to accommodate the soft member in the accommodating portion, wherein the soft member is wrapped in the accommodating portion while being in contact with an inner surface of the lid and an inner surface of the outsole, the solid-form soft member is a viscoelastic material in jelly-form, and the solid-form soft member and the outsole are formed in a U-shape, as viewed from the bottom of the shoe, at a rear foot portion of the shoe so that the lid has an exposed portion in a part of a central portion between a medial side and a lateral side of the rear foot portion, the exposed portion being exposed without being covered by the solid-form soft member and the outsole.

2. The shoe according to claim 1, wherein the outsole and the viscoelastic material have a skirt portion and/or an outwardly-protruding curved portion along a part of an outer edge of a shoe sole.

3. A shoe comprising:

a shock-absorbing member formed from a foam body including a thermoplastic resin component;

a solid-form soft member including a polymer resin component, having a greater weight per unit volume than the shock-absorbing member, having a hardness less than or equal to a hardness of the shock-absorbing member, and having a smaller volume change per unit volume, than the shock-absorbing member, for a change in external pressure within a predetermined range of external pressure;

the shock-absorbing member forms a lid configured to lid the soft member from a side of an upper; and an outsole including a thermoplastic resin component and having a tread surface, the outsole being rolled up upward along at least a part of an outer edge of the outsole, thereby defining an accommodating portion configured to accommodate the soft member between the outsole and the lid, wherein the soft member is wrapped in the accommodating portion while being in contact with at least a part of an inner surface of the lid and at least a part of an inner surface of the outsole, the solid-form soft member is a viscoelastic material in jelly-form, and the solid-form soft member and the outsole are formed in a U-shape, as viewed from the bottom of the shoe, at a rear foot portion of the shoe so that the lid has an exposed portion in a part of a central portion between a medial side and a lateral side of the rear foot portion, the exposed portion being exposed without being covered by the solid-form soft member and the outsole.

4. The shoe according to claim 3, wherein the outsole and the viscoelastic material have a skirt portion and/or an outwardly-protruding curved portion along a part of an outer edge of a shoe sole.

5. The shoe according to claim 3, wherein the outsole has planar and band-shaped attachment areas to be attached to a surface of the shock-absorbing member, and the attachment areas are provided over a part or whole of a portion of the inner surface of the outsole, the portion of the inner surface of the outsole being not in contact with the soft member.

6. The shoe according to claim 5, wherein at least a portion of the soft member lies under at least a portion of the shock-absorbing member.

7. The shoe according to claim 5, wherein the attachment areas comprise a first attachment area and a second attachment area;

the first attachment area is attached to a bottom surface of the shock-absorbing member; and the second attachment area is attached to a side surface of the shock-absorbing member.

8. The shoe according to claim 7, wherein the first and the second attachment areas of the outsole are continuous with each other in a loop, and are arranged to be continuous with each other in a loop along an edge of an entire circumference of the soft member.

9. The shoe according to claim 7, wherein the soft member enters a first portion of an undercut that is formed by a skirt portion and/or an outwardly-protruding curved portion of the outsole to fill the first portion, and the outsole and the soft member together define a second portion, into which the shock-absorbing member is fitted.

10. The shoe according to claim 9, wherein the soft member, the outsole and the shock-absorbing member each have a roll-up portion along at least a portion of an outer edge of a shoe sole;

the roll-up portion of the soft member extends along the roll-up portion of the shock-absorbing member and the roll-up portion of the outsole; and an upper edge of the roll-up portion of the soft member is lower than the roll-up portion of the shock-absorbing member and the roll-up portion of the outsole.

11. The shoe according to claim 3, wherein the outsole and the soft member are arranged at least on a lateral side of a rear foot portion of a shoe sole; and a volume of the soft member arranged on a medial side of the rear foot portion is smaller than the soft member on the lateral side, or the soft member is absent on the medial side.

12. A shoe comprising:

a shock-absorbing member formed from a foam body including a thermoplastic resin component;

a solid-form soft member including a polymer resin component, having a greater weight per unit volume than the shock-absorbing member, having a hardness less than or equal to a hardness of the shock-absorbing member, and having a smaller volume change per unit volume, than the shock-absorbing member, for a change in external pressure within a predetermined range of external pressure; and an outsole including a thermoplastic resin component and having a tread surface, the outsole being rolled up upward along at least a part of an outer edge of the outsole, thereby defining an accommodating portion configured to accommodate the soft member between the outsole and a lid, wherein the shock-absorbing member forms the lid configured to lid the soft member from a side of an upper;

the soft member is wrapped in the accommodating portion while being in contact with at least a part of an inner surface of the shock-absorbing member and at least a part of an inner surface of the outsole;

the solid-form soft member is a viscoelastic material in jelly-form, and the solid-form soft member and the outsole are foi tied in a U-shape, as viewed from the bottom of the shoe, at a rear foot portion of the shoe so that the lid has an exposed portion in a part of a central portion between a medial side and a lateral side of the rear foot portion, the exposed portion being exposed without being covered by the solid-form soft member and the outsole.

13. The shoe according to claim 12, wherein the outsole has planar and band-shaped attachment areas to be attached to a surface of the shock-absorbing member, and the attachment areas are provided over a part of a portion of the inner surface of the outsole, the portion of the inner surface of the outsole being not in contact with the soft member;

the attachment areas comprise a first attachment area and a second attachment area;

the first attachment area is attached to a bottom surface of the shock-absorbing member; and the second attachment area is attached to a side surface of the shock-absorbing member.

14. The shoe according to claim 13, wherein the shock-absorbing member, the soft member and the outsole are provided over at least a part of a rear foot portion of a shoe sole;

the first attachment area is arranged on a central portion between a medial side and a lateral side of the rear foot portion, and the second attachment area is arranged on at least one of a side surface on the medial side and a side surface on the lateral side of the rear foot portion of the shock-absorbing member; and the soft member is arranged in an area between the first attachment area arranged on the central portion and the second attachment area arranged on the side surface.

15. The shoe according to claim 13, wherein the first and the second attachment areas of the outsole are continuous with each other in a loop, and are arranged to be continuous with each other in a loop along an edge of an entire circumference of the soft member.

16. The shoe according to claim 12, wherein the soft member, the outsole and the shock-absorbing member each have a roll-up portion along at least a portion of an outer edge of a shoe sole;

the roll-up portion of the soft member extends along the roll-up portion of the shock-absorbing member and the roll-up portion of the outsole; and an upper edge of the roll-up portion of the soft member is lower than the roll-up portion of the shock-absorbing member and the roll-up portion of the outsole.

17. The shoe according to claim 12, wherein the outsole and the soft member are arranged at least on a lateral side of a rear foot portion of a shoe sole; and a volume of the soft member arranged on a medial side of the rear foot portion is smaller than the soft member on the lateral side, or the soft member is absent on the medial side.

* * * * *